US011591782B2

(12) United States Patent
Stack et al.

(10) Patent No.: US 11,591,782 B2
(45) **Date of Patent: *Feb. 28, 2023**

(54) ANTI-OVERFLOW TOILET

(71) Applicant: Penguin Licensing, LLC, Northville, MI (US)

(72) Inventors: Patrick Gerard Stack, Northville, MI (US); Lawrence A Trowbridge, Dripping Springs, TX (US); Joan Marie Stoneburner, Commerce Township, MI (US); Mauricio Hector Zambrano, Apodaca (MX)

(73) Assignee: Penguin Products, LLC, Northville, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/410,634

(22) Filed: Aug. 24, 2021

(65) Prior Publication Data

US 2022/0145605 A1 May 12, 2022

Related U.S. Application Data

(63) Continuation-in-part of application No. 17/096,523, filed on Nov. 12, 2020, now Pat. No. 11,118,335.

(51) Int. Cl.
*E03D 5/02* (2006.01)
*A47K 17/02* (2006.01)

(52) U.S. Cl.
CPC ..... *E03D 5/026* (2013.01); *A47K 17/028* (2013.01)

(58) Field of Classification Search
CPC ..... E03D 1/26
USPC ..... 4/254, 420, 427
See application file for complete search history.

(56) References Cited

U.S. PATENT DOCUMENTS 1,155,885 A * 10/1915 Catchings ..... A47K 17/028 4/420
2,075,030 A * 3/1937 Dunean, Jr. ..... E03D 11/18 4/422
3,262,132 A * 7/1966 Mann ..... E03D 11/13 4/427
5,987,657 A * 11/1999 Byers ..... A47K 17/028 4/254
2015/0299998 A1* 10/2015 Stack ..... E03D 11/13 4/427

FOREIGN PATENT DOCUMENTS

EP 0413063 A1 * 2/1991 ..... E03D 11/04

* cited by examiner

*Primary Examiner* — Christine J Skubinna
(74) *Attorney, Agent, or Firm* — Quinn IP Law

(57) ABSTRACT

A toilet configuration that is connectable to a sewer drainage pipe is provided. The toilet configuration includes a water storage tank, a ceramic toilet body including a toilet bowl, and a water supply plenum operable to receive water from the water storage tank and channel the water to the toilet bowl. The toilet configuration further includes a primary drain operable to fluidly connect the waste receiving basin and the sewer drainage pipe and at least one footrest formed unitarily with an outer surface of the ceramic toilet body. The footrest is operable to aid a user in elevating at least one knee while the user is seated upon the toilet configuration.

5 Claims, 11 Drawing Sheets

ANTI-OVERFLOW TOILET

CROSS-REFERENCE TO RELATED APPLICATIONS

This disclosure is a continuation-in part of and claims priority to U.S. patent application Ser. No. 17/096,523 filed on Nov. 12, 2020, which is hereby incorporated by reference.

TECHNICAL FIELD

This disclosure relates to an improved bathroom fixture for flushing bodily waste materials into a drainage or sewer system. More particularly, this disclosure includes a toilet having a unitarily formed footrest.

SUMMARY

A toilet configuration that is connectable to a sewer drainage pipe is provided. The toilet configuration includes a water storage tank, a ceramic toilet body including a toilet bowl including a waste receiving basin, and a water supply plenum operable to receive water from the water storage tank and channel the water to the toilet bowl. The toilet configuration further includes a primary drain operable to fluidly connect the waste receiving basin and the sewer drainage pipe and at least one footrest formed unitarily with an outer surface of the ceramic toilet body. The at least one footrest is operable to aid a user in elevating at least one knee while the user is seated upon the toilet configuration.

In some embodiments, the at least one footrest includes a single footrest spanning from a first side of the outer surface to a second side of the outer surface.

In some embodiments, the at least one footrest includes a first footrest disposed upon a first side of the outer surface and a second footrest disposed upon a second side of the outer surface.

In some embodiments, the toilet configuration further includes a secondary drain operable to drain the water from the toilet bowl into the sewer drainage pipe. The secondary drain is separate from the primary drain.

In some embodiments, the waste receiving basin includes an upper rim and at least one toilet bowl annular connection feature in a side wall of the waste receiving basin. The secondary drain is operable to fluidly connect the toilet bowl annular connection feature to the sewer drainage pipe and operable to drain the water from the toilet bowl annular connection feature into the sewer drainage pipe. Throughout the disclosure, an annular connection feature may alternatively be described as an aperture, an opening, an inlet or outlet, or a ring-shaped feature in the toilet structure providing fluid connection from one portion of the toilet fixture to another portion of the toilet fixture.

In some embodiments, the secondary drain includes an auxiliary annular connection feature fluidly connecting the secondary drain to the water supply plenum, wherein the auxiliary annular connection feature is operable to drain the water from the water supply plenum into the sewer drainage pipe.

In some embodiments, the toilet configuration further includes a water supply jet outlet operable to receive the water channeled by the water supply plenum and direct the water into the waste receiving basin. The water supply plenum includes two water pathways connecting the water supply plenum to the water supply jet outlet, the two water pathways including a first water pathway extending around a first side of the toilet bowl and a second water pathway extending around a second side of the toilet bowl.

In some embodiments, the auxiliary annular connection feature is located vertically below the at least one toilet bowl annular connection feature.

In some embodiments, the secondary drain further includes an airlock relief annular connection feature including an annular connection feature fluidly connecting the secondary drain to the water supply plenum.

In some embodiments, the airlock relief annular connection feature is at a top of the secondary drain.

In some embodiments, the water supply plenum includes a secondary drain inlet. The secondary drain is operable to fluidly connect the secondary drain inlet to the sewer drainage pipe and operable to drain the water from the toilet bowl, through the water supply plenum, through the secondary drain inlet, and into the sewer drainage pipe.

In some embodiments, the water supply plenum includes a diverter wall operable to prevent a portion of water flowing from the water tank from entering the secondary drain inlet.

According to one alternative embodiment, a toilet configuration that is connectable to a sewer drainage pipe is provided. The toilet configuration includes a water storage tank, a ceramic toilet body including a toilet bowl including a waste receiving basin that includes an upper rim and at least one toilet bowl annular connection feature in a side wall of the waste receiving basin, and a water supply plenum operable to receive water from the water storage tank and channel the water to the toilet bowl. The toilet configuration further includes a primary drain operable to fluidly connect the waste receiving basin and the sewer drainage pipe and a secondary drain operable to fluidly connect the toilet bowl annular connection feature to the sewer drainage pipe and operable to drain the water from the toilet bowl into the sewer drainage pipe. The secondary drain is separate from the primary drain and includes an auxiliary annular connection feature located vertically below the at least one toilet bowl annular connection feature fluidly connecting the secondary drain to the water supply plenum. The auxiliary annular connection feature is operable to drain the water from the water supply plenum into the sewer drainage pipe. The toilet configuration further includes at least one footrest formed unitarily with an outer surface of the ceramic toilet body. The at least one footrest is operable to aid a user in elevating at least one knee while the user is seated upon the toilet configuration. The toilet bowl annular connection feature and the auxiliary annular connection feature are operable to permit the water to bypass the primary drain when the primary drain is clogged.

In some embodiments, the at least one footrest includes a single footrest spanning from a first side of the outer surface to a second side of the outer surface.

In some embodiments, the at least one footrest includes a first footrest disposed upon a first side of the outer surface and a second footrest disposed upon a second side of the outer surface.

According to one alternative embodiment, a toilet configuration that is connectable to a sewer drainage pipe is provided. The toilet configuration includes a water storage tank, a ceramic toilet body including a toilet bowl including a waste receiving basin that includes an upper rim and at least one toilet bowl annular connection feature in a side wall of the waste receiving basin, and a water supply plenum operable to receive water from the water storage tank and channel the water to the toilet bowl. The toilet configuration further includes a primary drain operable to fluidly connect the waste receiving basin and the sewer drainage pipe and at least one footrest formed unitarily with an outer surface of the ceramic toilet body. The at least one footrest is operable to aid a disabled user in elevating at least one knee while the disabled user is seated upon the toilet configuration. The toilet bowl annular connection feature is operable to permit the water to bypass the primary drain when the primary drain is clogged.

In some embodiments, the toilet configuration further includes a secondary drain operable to fluidly connect the toilet bowl annular connection feature to the sewer drainage pipe and operable to drain the water from the toilet bowl into the sewer drainage pipe. The secondary drain is separate from the primary drain and includes an auxiliary annular connection feature located vertically below the at least one toilet bowl annular connection feature fluidly connecting the secondary drain to the water supply plenum. The auxiliary annular connection feature is operable to drain the water from the water supply plenum into the sewer drainage pipe and prevent the disabled user from causing the toilet configuration to overflow.

BRIEF DESCRIPTION OF THE DRAWINGS

One or more embodiments will now be described, by way of example, with reference to the accompanying drawings, in which.

DETAILED DESCRIPTION

Figure 1:
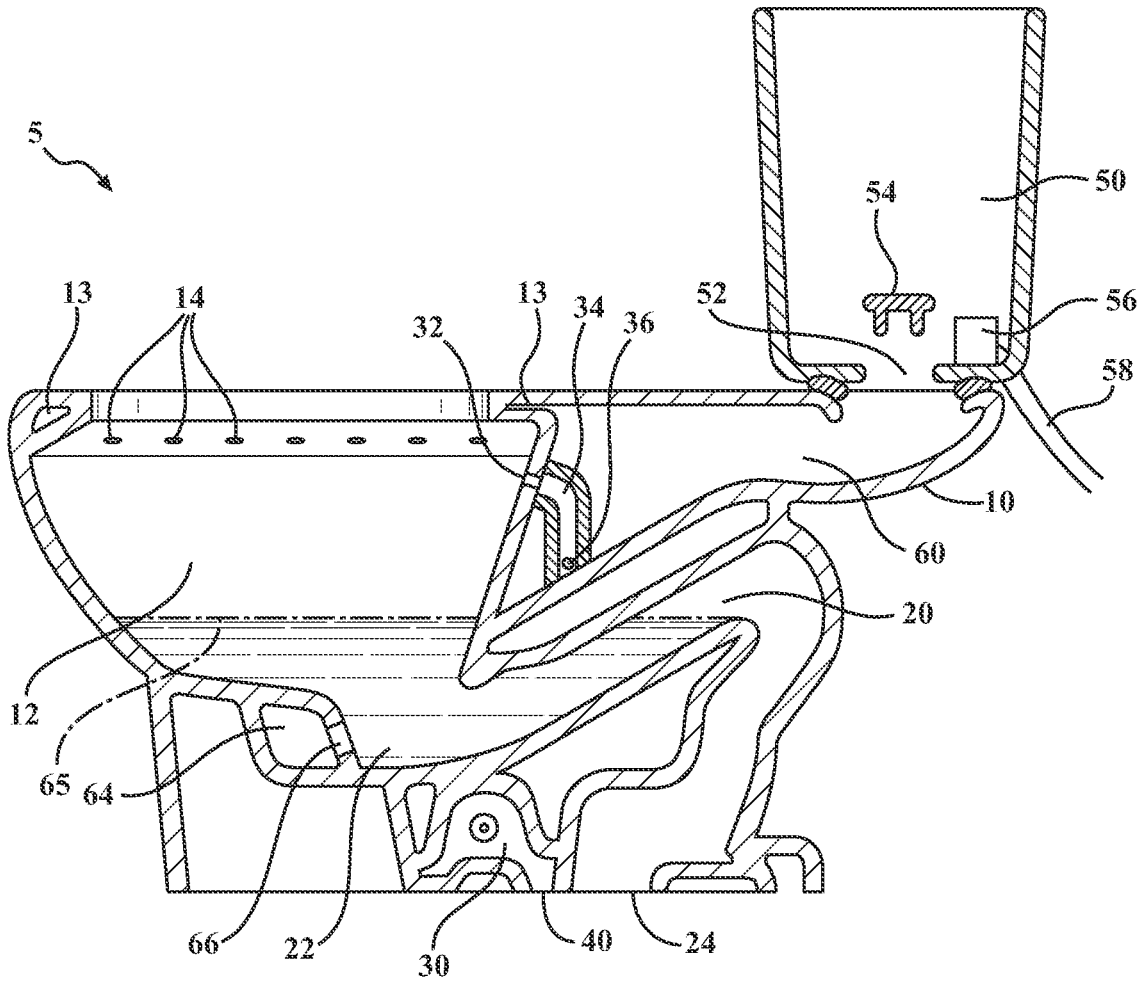
FIG. 1 schematically illustrates an exemplary toilet configuration in side sectional view including a secondary drain, wherein the secondary drain is connected to an annular connection feature in a toilet bowl and includes an auxiliary annular connection feature within a water supply plenum of the toilet configuration, in accordance with the present disclosure.

An anti-overflow toilet is specially designed to be utilized to provide a toileting option to handicapped and disabled persons. A number of factors may cause a clogged toilet to overflow. Contributing factors may include a blind user not being able to see the water level rising, a deaf user not being able to hear that the toilet did not successfully flush, a user with dementia may not understand that the toilet is clogged, and a mentally handicapped user may not understand that a clogged toilet will overflow. The toilets described herein including overflow protection may forestall or prevent a toilet overflowing, thereby avoiding slip and fall danger, sanitary issues, and preventing damage to a floor structure that may result from being inundated with toilet water.

An anti-overflow toilet configuration is provided including enhanced primary drain bypass flow operable to drain water flow through the toilet which may result from a broken, sheared off, or stuck in an open position water supply fill valve within a water storage tank.

Toilets include a water supply fill valve which selectively provides or cuts off a flow of water from a water supply line connected to the toilet. A water storage tank includes an overflow pipe or overflow channel, such that excess water within the water storage tank flows into the toilet bowl. A stuck open water supply fill valve may cause the toilet to continuously fill at a same rate that occurs after a normal flush. However, when a fill valve is damaged, destroyed, or otherwise broken, an unrestricted flow of water may flow from the water supply line into the toilet. A toilet further includes a primary drain, the passageway at the bottom or base of the toilet bowl through which water and waste flow during a normal operational flush of the toilet. The primary drain is connected to a sewer pipe which leads away from the toilet into a sewer system. An unrestricted flow of water from a broken water supply fill valve may be able to flow through an unclogged primary drain and into the sewer pipe without causing the toilet to overflow. However, in the event of a clogged primary drain, with no way for water to get from the broken water supply fill valve to the sewer pipe, the flow of water through the toilet overflows from the toilet into the surrounding area.

Secondary drains are useful in a toilet to bypass the primary drain and prevent a toilet from overflowing. Secondary drains connect the toilet bowl or other plumbing within the toilet to the sewer pipe with plumbing distinct and separate from the primary drain. In the event of a clog in the primary drain, water may flow through the secondary drain to prevent the water from overflowing from the toilet. A toilet bowl includes a designed water level to which the toilet normally fills after a flush.

In one embodiment, a secondary drain may include one or more annular connection features in the toilet bowl, for example, above the designed water level for the toilet bowl. As described herein, an annular connection feature in a toilet wall or surface refers to a round, oval, or other shaped feature formed upon the toilet wall or surface providing a fluid connection between one region of the toilet and another region of the toilet, for example, providing a fluid connection between either the toilet bowl or the water supply plenum and a secondary drain. In normal operation, the water may rarely or intermittently raise to the level of the annular connection features in the toilet bowl. When the primary drain of the toilet is clogged, a water level may rise within the toilet bowl to a level at or above the annular connection features in the toilet bowl. The water may then drain out of the toilet bowl, through the annular connection features, into the secondary drain, and into the sewer pipe, thereby averting an overflow due to the clogged primary drain. However, water does not begin to drain from the toilet bowl until the water level reaches the annular connection features in the toilet bowl. With unrestricted flow of water through the toilet resulting from a broken water supply fill valve, by the time the water level reaches the annular connection features in the toilet bowl, a capacity of the toilet to hold standing water may be substantially filled, thereby reducing a factor of safety for the toilet to drain sufficiently to prevent an overflow. Further, a depth of water that will be present at the annular connection features in the toilet bowl is limited. Head pressure refers to the pressure that water exerts. Head pressure at the annular connection features, due to the limited depth of the water above the annular connection features in the toilet bowl, is limited, and therefore, a flow of water through the annular connection features in the toilet bowl is limited. For these reasons, annular connection features in a toilet bowl, by themselves, connected to a secondary drain are unlikely to be able to sufficiently drain a toilet with an unrestricted flow of water resulting from a broken water supply fill valve.

In one embodiment, a toilet may include a water storage tank. The water supply fill valve may be configured to fill the water storage tank to a particular level. When the toilet is flushed, a flapper valve or other similar device may release water from the water storage tank into a water supply plenum or a passage leading from the water storage tank to the toilet bowl. In one embodiment, the water supply plenum may include passages leading from the water storage tank to water supply annular connection feature located around a perimeter of an underside of a toilet bowl rim. In another embodiment, the water supply plenum may include a water supply jet outlet located at a bottom of the toilet bowl and operable to supply a jet of water during a flush into the primary drain.

In one embodiment, one or more annular connection features may be provided within the water supply plenum. A secondary drain may be connected to the annular connection features in the water supply plenum. When a primary drain is clogged and water backs up within a toilet bowl, water may similarly back up within the water supply plenum, for example, equalizing with a water level in the bowl through the water supply jet opening and/or flowing backward through the water supply annular connection features around the perimeter of the toilet bowl rim. Water may be drained from the toilet through annular connection features in the water supply plenum and a connected secondary drain into the sewer pipe. Depending upon placement and geometry of the annular connection feature in the water supply plenum, water may flow or divert through the secondary drain during normal operation of the toilet, potentially reducing an overall effectiveness of the normal flushing of the toilet.

Airlock or vapor lock is a condition where flow of a liquid through a pipe or other vessel is slowed or stopped by presence of an air pocket within the pipe. An airlock condition may clear over time, with water flow pushing bubbles of air out of the pipe, but the airlock may for some period of time slow or cease water flow through a pipe. A delay or interference of water flow through a secondary drain may cause or contribute to water overflowing from a toilet. Air tends to raise to a top or highest vertical position within a pipe. An annular connection feature may be placed in an uppermost position within a pipe to enable air to be pushed out of the pipe and thereby quickly release an airlock condition.

A water supply plenum may connect a water storage tank to a water supply jet opening. In some embodiments, the water supply plenum may include a water pathway transiting around and formed integrally with one outer side of the toilet bowl. When water is flowing through the toilet from a broken water supply fill valve as an unrestricted flow of water, increasing a capacity of the secondary drain and internal plumbing of the toilet to bypass the primary drain may be advantageous to avoid overflow. In one embodiment, in order to maximize a water flow from the toilet bowl to an opening of a secondary drain within the water supply plenum, the water supply plenum may include two water pathways connecting in parallel to the water supply jet opening.

A toilet bowl may include a plurality of annular connection features connected to a secondary drain. The secondary drain may include a pipe, passageway, or hollow portion within and transiting water through the water supply plenum. The secondary drain may lead to a portion of the toilet that connects with the sewer pipe and may include an outlet leading into the sewer pipe separate and distinct from an outlet from the primary drain leading into the sewer pipe. In a portion of the secondary drain that is within the secondary drain plenum, the secondary drain may include an auxiliary annular connection feature permitting water within the water supply plenum to enter the secondary drain. In this way, water may flow from both the toilet bowl through the annular connection features in the toilet bowl into the secondary drain and the water supply plenum through the auxiliary annular connection feature into the secondary drain.

Referring now to the drawings, wherein the showings are for the purpose of illustrating certain exemplary embodiments and not for the purpose of limiting the same, FIG. 1 schematically illustrates an exemplary toilet configuration in side sectional view including a secondary drain, wherein the secondary drain is connected to an annular connection feature in a toilet bowl and includes an auxiliary annular connection feature within a water supply plenum of the toilet configuration. Configuration 5 includes fixture 10 with a water storage tank 50, a toilet bowl 12, and a primary drain 20. Water is held in the water storage tank 50 by tank valve 54. Once the tank valve 54 is opened, water rushes according to the pull of gravity through tank annular connection feature 52 and enters the water supply plenum 60 of the fixture 10. Water supply plenum 60 is a closed fluid connection and fluidly connects water storage tank 50 with toilet bowl 12. In another embodiment, a flushometer-type valve may be used with a tank-less toilet, wherein depression of the flushometer-type valve causes a surge of water to enter the water supply plenum 60. A wide variety of toilet designs are envisioned for use with the configurations disclosed herein, and the disclosure is not intended to be limited by the particular examples provided. The water storage tank 50 may include a water supply fill valve 56 connected to a water supply line 58 to provide a selective flow of water into the water storage tank 50. The water supply plenum 60 receives the flow of water from the water storage tank 50 and channels the water flow to different destinations for the purpose of flushing the fixture, emptying contents of the bowl, and refilling the bowl after the flush. A portion of the water flow within the water supply plenum 60 is channeled to a channel 13 circumventing the rim of the toilet bowl 12. Water within the channel 13 flows through annular connection features 14 and into the toilet bowl 12. A portion of the water flow within the water supply plenum 60 is channeled through a passage which progresses around the bowl and fluidly connects with the jet channel 64. Water exits the jet channel 64 through the water jet annular connection feature 66 to provide flushing action/head pressure to the primary drain 20 at a primary drain inlet 22. Water and waste from the toilet bowl 12 and water from jet channel 64 enter the primary drain 20 and flush through the primary drain 20 as the column of water and waste create a siphon in accordance with operation of a fixture as is used in the art. The water and waste exit the fixture through a primary drain outlet 24. The primary drain outlet 24 is coupled to a structure sewage pipe channeling the waste to other sewage pipes and subsequently out of the structure.

A secondary drain 34 is illustrated within the water supply plenum 60. The secondary drain 34 includes toilet bowl annular connection features 32 operable to drain water from the toilet bowl 12 if water rises within toilet bowl 12 to the level of the toilet bowl annular connection features 32. The primary drain 20 and the toilet bowl 12 are configured such that during normal operation, water fills in the toilet bowl 12 until a corresponding operational fill water level 65 within the primary drain 20 causes water filling fixture to overflow the bend in primary drain 20. In this way, a normal water level for the bowl 12 to achieve during a filling cycle of the fixture is set at the operational fill water level 65. When the primary drain 20 clogs, water entering the toilet bowl 12 through the water supply plenum rises, and if this rise in the water level is unchecked, the water may overflow the toilet bowl 12. The toilet bowl annular connection features 32 prevent such an overflow by permitting water to bypass the primary drain 20 through the secondary drain 34. Additionally, an auxiliary annular connection feature 36 may be formed in the secondary drain 34 within the water supply plenum 60, such that water filling the water supply plenum 60 over the operational fill water level 65 may additionally bypass the primary drain 20.

Because the operational fill water level 65 also defines a water level within water supply plenum 60, it is noted that any auxiliary annular connection feature 36 of the secondary drain 34 may be located above the bend in primary drain 20 and above the operational fill water level 65 such that water will not drain from the water supply plenum 60 through the secondary drain when the bowl is filled to a normal designed level. However, the auxiliary annular connection feature 36 may be located within some threshold distance from water level 65 so as to begin draining the water supply plenum 60 as soon as water rises above the operational fill water level 65. In this way, the secondary drain has an enhanced ability to keep the water from overflowing the toilet bowl 12.

The secondary drain 34 is fluidly connected to the secondary drain channel 30. A passage may be formed integrally within the fixture 10 to connect the secondary drain 34 and the secondary drain channel 30. A passage connecting the secondary drain 34 and the secondary drain channel 30 may include a water trap according to plumbing methods used in the art. Water within secondary drain channel 30 may exit the fixture through the secondary drain outlet 40. In another embodiment, the secondary drain channel 30 may be configured to empty into the primary drain 20 just above the primary drain outlet 24. The primary drain outlet 24 and the secondary drain outlet 40 may be configured to connect to a standard plumbing connection used in the art. In such an embodiment, secondary drain outlet 40 may be configured to extend through a collar region of the fixture and discharge water directly into the standard plumbing connection. Water may be channeled from the water supply plenum 60 into secondary drain 34 through the auxiliary annular connection feature 36 for the purpose of flushing the secondary drain and cleaning it out.

If a clog in the primary drain 20 prevents water and waste from exiting the toilet bowl 12, the water level in the toilet bowl 12 rises and eventually flows through the toilet bowl annular connection features 32. As the water level in the toilet bowl 12 rises, a water level within the water supply plenum 60 will also rise. Water from the toilet bowl annular connection features 32 and from the auxiliary annular connection feature 36 flows to the secondary drain channel 30, and flows out of the secondary drain outlet 40. By flowing through the secondary drain, water bypasses the clog in the primary drain 20 and prevents the fixture from overflowing out of the bowl. By sizing the toilet bowl annular connection features 32, the auxiliary annular connection feature 36, and the secondary drain 34 adequately, a broken water supply fill valve 56 may be accounted for, with an unrestricted flow of water from the water supply line 58 being channeled through the secondary drain without the toilet overflowing.

More than one secondary drain 34 and/or more than one auxiliary annular connection feature 36 may be used to channel water from the water supply plenum 60.

Secondary drain annular connection features such as the toilet bowl annular connection features 32 and the auxiliary annular connection feature 36 may be formed integrally with the wall during the process of constructing the fixture, for example, prior to the porcelain material being heated, or the secondary drain annular connection features may be added to the walls of the fixture through a drilling process after the construction of the fixture.

The embodiment of FIG. 1 includes the jet channel 64. Some toilet configurations include a water jet channel and some do not. A secondary drain inlet within a water supply plenum may still work within a fixture wherein water enters the bowl through annular connection features around the rim. However, water from the rising level in the bowl will not enter the plenum until the water level exceeds the height of the annular connection features around the rim. In such an exemplary configuration, larger annular connection features around the rim and/or a portion of annular connection features around the rim placed lower in the bowl could facilitate water flowing from a bowl back into the plenum before the water level gets too high in the bowl.

Figure 2:
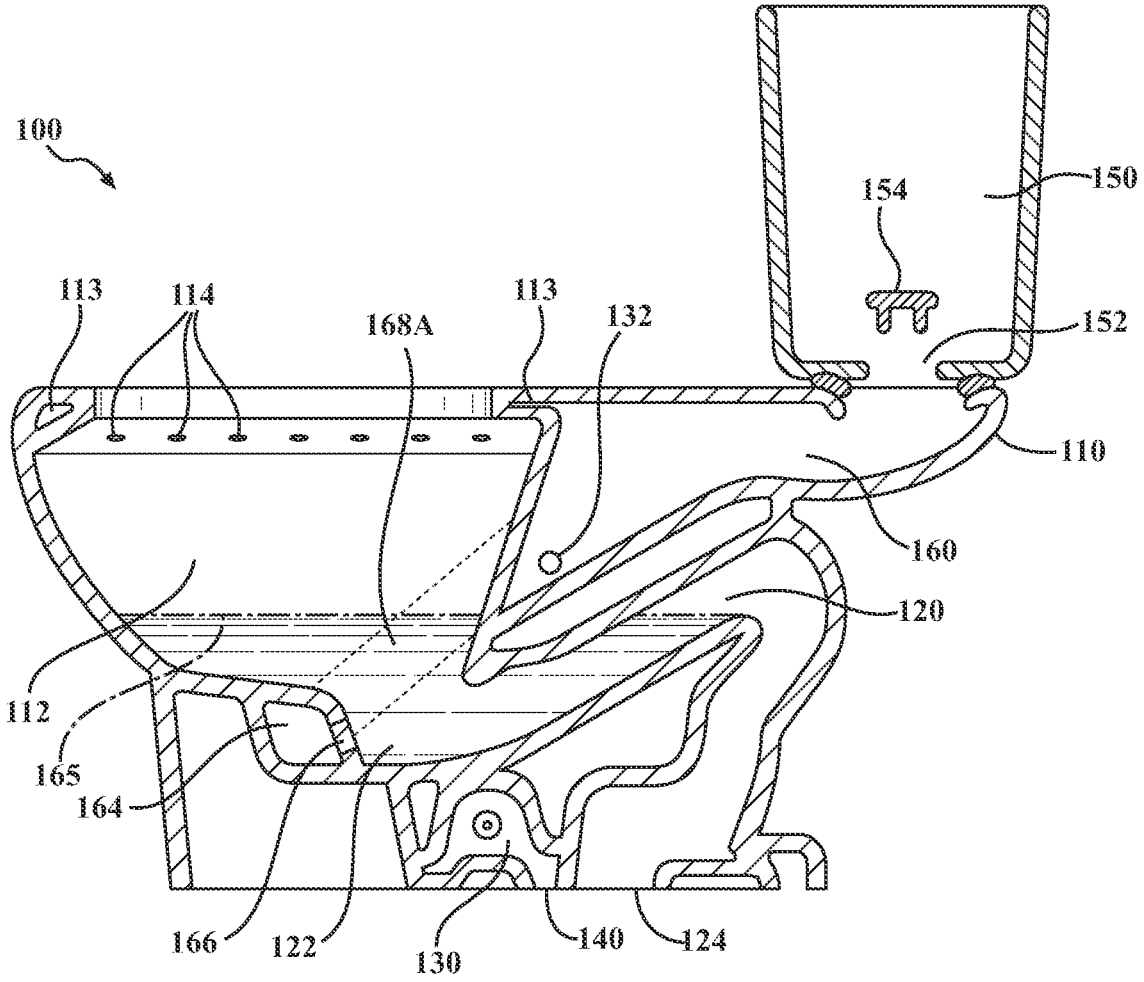
FIG. 2 schematically illustrates an alternative exemplary toilet configuration in side sectional view including a water supply plenum including two water pathways connecting in parallel to the water supply jet opening, in accordance with the present disclosure.

FIG. 2 schematically illustrates an alternative exemplary toilet configuration in side sectional view including a water supply plenum including two water pathways connecting in parallel to the water supply jet opening. Configuration 100 includes fixture 110 with a water storage tank 150, a toilet bowl 112, and a primary drain 120. Water is held in the water storage tank 150 by tank valve 154. Once the tank valve 154 is opened, water rushes according to the pull of gravity through tank annular connection feature 152 and enters the water supply plenum 160 of the fixture 110. The water supply plenum 160 receives the flow of water from the water storage tank 150 and channels the water flow to different destinations for the purpose of flushing the fixture, emptying contents of the bowl, and refilling the bowl after the flush. A portion of the water flow within the water supply plenum 160 is channeled to a channel 113 circumventing the rim of the toilet bowl 112. Water within the channel 113 flows through annular connection features 114 and into the toilet bowl 112. A portion of the water flow within the water supply plenum 160 is channeled through at least one water pathway 168A which progresses around the bowl and fluidly connects with the jet channel 164. Water exits the jet channel 164 through the water jet annular connection feature 166 to provide flushing action/head pressure to the primary drain 120 at a primary drain inlet 122. Water and waste from the toilet bowl 112 and water from jet channel 164 enter the primary drain 120 and flush through the primary drain 120 as the column of water and waste create a siphon in accordance with operation of a fixture as is used in the art. The water and waste exit the fixture through a primary drain outlet 124. The primary drain outlet 124 is coupled to a structure sewage pipe channeling the waste to other sewage pipes and subsequently out of the structure.

A secondary drain annular connection feature 132 is illustrated within the water supply plenum 160. The primary drain 120 and the toilet bowl 112 are configured such that, during normal operation, water fills in the toilet bowl 112 until a corresponding operational fill water level 165 within the primary drain 120 causes water filling fixture to overflow the bend in primary drain 120. In this way, a normal water level for the bowl 112 to achieve during a filling cycle of the fixture is set at the operational fill water level 165. Because the operational fill water level 165 also defines a water level within water supply plenum 160, it is noted that any secondary drain annular connection feature 132 may be located above the bend in primary drain 120 and above the operational fill water level 165 such that water will not drain from the water supply plenum 160 through the secondary drain when the bowl is filled to a normal designed level. However, the secondary drain annular connection feature 132 may be located within some threshold distance from water level 165 so as to begin draining the water supply plenum 60 as soon as water rises above the operational fill water level 165. In this way, the secondary drain has an enhanced ability to keep the water from overflowing the toilet bowl 112.

The secondary drain annular connection feature 132 is fluidly connected to the secondary drain channel 130 by a secondary drain passage. The passage of the secondary drain may be formed integrally within the fixture 110 to connect the secondary drain annular connection feature 132 and the secondary drain channel 130. The passage connecting the secondary drain annular connection feature 132 and the secondary drain channel 130 may include a water trap according to plumbing methods used in the art. Water within secondary drain channel 130 may exit the fixture through the secondary drain outlet 140. In another embodiment, the secondary drain channel 130 may be configured to empty into the primary drain 120 just above the primary drain outlet 124. The primary drain outlet 124 and the secondary drain outlet 140 may be configured to connect to a standard plumbing connection used in the art. In such an embodiment, secondary drain outlet 140 may be configured to extend through a collar region of the fixture and discharge water directly into the standard plumbing connection. Water may be channeled from the water supply plenum 160 into secondary drain annular connection feature 132 through the auxiliary annular connection feature 36 for the purpose of flushing the secondary drain and cleaning it out.

If a clog in the primary drain 120 prevents water and waste from exiting the toilet bowl 112, the water level in the toilet bowl 112 rises. As the water level in the toilet bowl 112 rises, a water level within the water supply plenum 160 will also rise. As the water level within the plenum reaches and enters the secondary drain annular connection feature 132, water flows to the secondary drain channel 130 and flows out of the secondary drain outlet 140. By flowing through the secondary drain, water from the water supply plenum 160 bypasses the clog in the primary drain 120 and prevents the fixture from overflowing out of the bowl.

More than one secondary drain annular connection feature 132 may be used to channel water from the water supply plenum 160.

Secondary drain annular connection features such as the secondary drain annular connection feature 132 may be formed integrally with the wall during the process of constructing the fixture, for example, prior to the porcelain material being heated, or the secondary drain annular connection features may be added to the walls of the fixture through a drilling process after the construction of the fixture.

Figure 3:
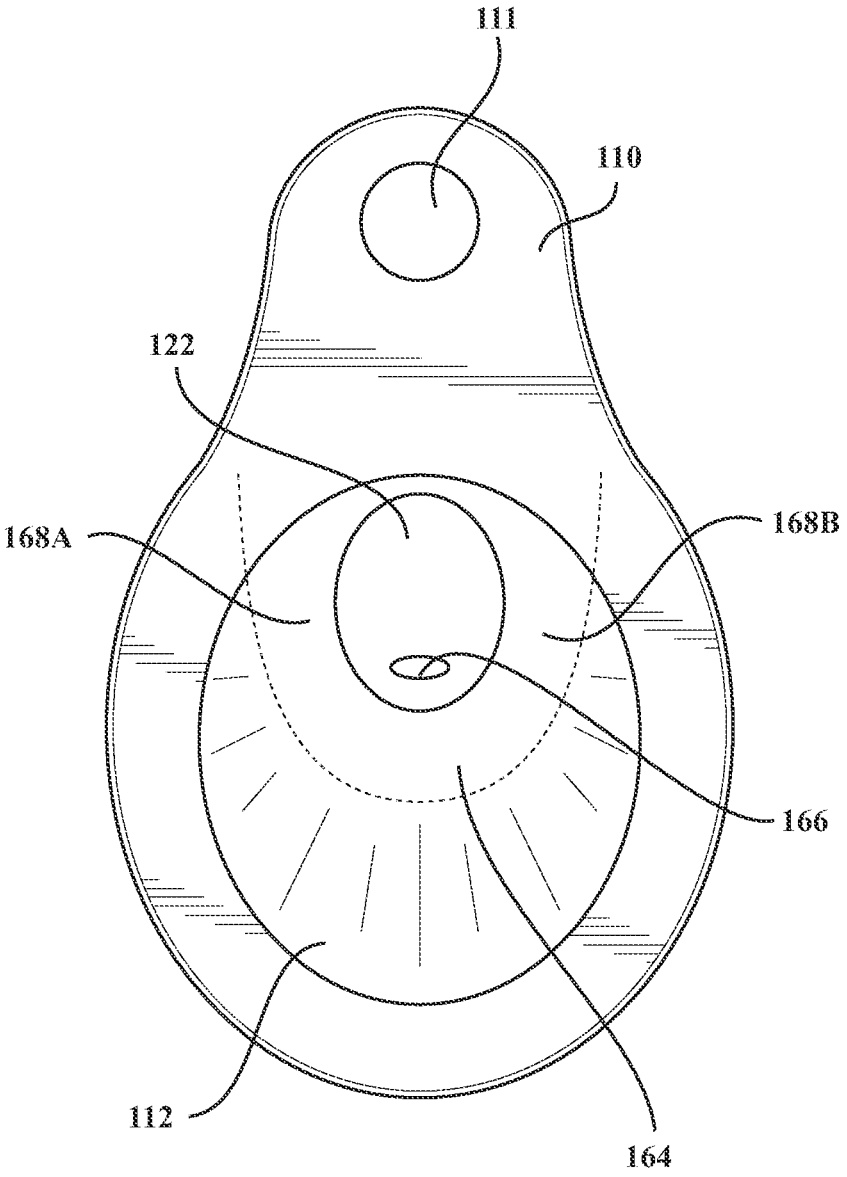
FIG. 3 schematically illustrates the toilet configuration of FIG. 2 in top view, illustrating the two water pathways extending around a first side of a toilet bowl of the toilet configuration and around a second side of the toilet bowl, in accordance with the present disclosure.

FIG. 3 schematically illustrates the toilet configuration of FIG. 2 in top view, illustrating the two water pathways extending around a first side of a toilet bowl of the toilet configuration and around a second side of the toilet bowl. Fixture 110 is illustrated including tank interface annular connection feature 111, a toilet bowl 112, a primary drain inlet 122, a water jet channel 164, and a water jet annular connection feature 166. Dotted lines illustrate a first water pathway, the water pathway 168A, and a second water pathway, the water pathway 168B, each connecting a water supply plenum within fixture 110 to the water jet channel 164 and the water jet annular connection feature 166. While toilets may include a single water pathway 168A connecting water supply plenum 160 to jet channel 164 through the water jet annular connection feature 166, more than one water pathway may be advantageously utilized. For example, in the event of a water supply fill valve failure, the water pathway 168A and a water pathway 168B may be utilized in parallel to increase an amount of water that may flow from toilet bowl 112 to water supply plenum 160 in the event that the primary drain 120 is clogged. Water channeled through the water pathway 168A and the water pathway 168B into the water supply plenum 160 may be drained out of the water supply plenum 160 through an auxiliary annular connection feature in a secondary drain.

Figure 4:
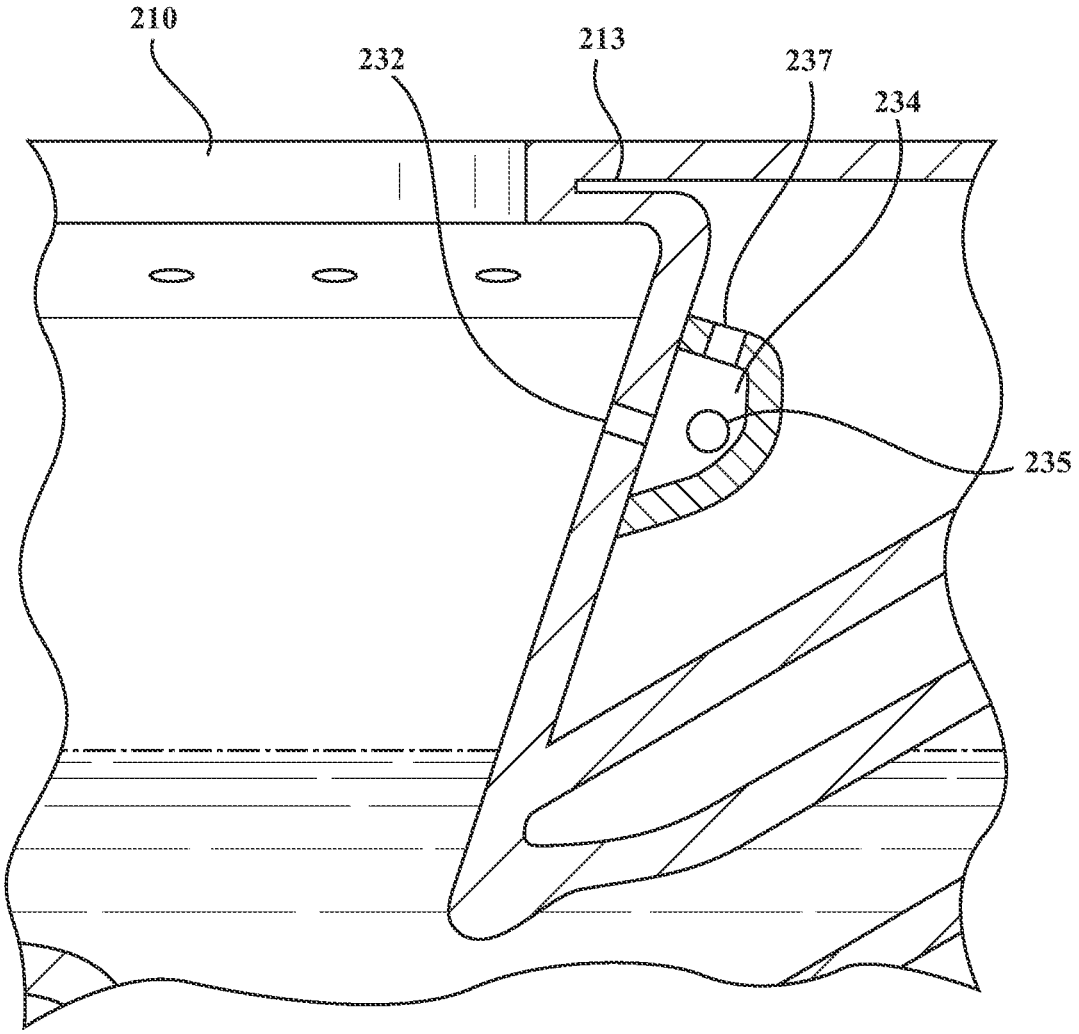
FIG. 4 schematically illustrates an alternative exemplary toilet configuration in side sectional view including a secondary drain including an airlock relief annular connection feature at an upper point of the secondary drain, in accordance with the present disclosure.

FIG. 4 schematically illustrates an alternative exemplary toilet configuration in side sectional view including a secondary drain including an airlock relief annular connection feature at an upper point of the secondary drain. Fixture 210 is illustrated and is similar to the fixture 10 of FIG. 1. FIG. 4 includes a magnified view of a toilet bowl of the fixture 210, including one or more toilet bowl annular connection features 232. A portion of the water flow within the water supply plenum is channeled to a channel 213 circumventing the rim of the toilet bowl. A secondary drain cavity 234 is illustrated within a water supply plenum including the secondary drain 235 which connects with a secondary drain outlet. When a primary drain of the toilet is clogged, water may back up within the toilet bowl, and water may flow through the toilet bowl annular connection features 232 into the secondary drain cavity 234 and subsequently into the secondary drain 235.

An airlock condition may occur, wherein water within the secondary drain cavity may fail to quickly drain through the secondary drain 235 due to air trapped within the secondary drain cavity 234. An airlock relief annular connection feature 237 is illustrated at a top of the secondary drain cavity 234 or at a top of the secondary drain 235. Because air rises within a column of water, by placing the airlock relief annular connection feature 237 at or near a top of the secondary drain 235, an airlock condition within the secondary drain may be avoided and flow through the secondary drain 235 during a clogged primary drain event may be maximized. When water flows through the toilet bowl annular connection features 232 into the secondary drain cavity 234, the water may force air from the secondary drain cavity 234 through the airlock relief annular connection feature 237, thereby preventing an airlock condition within the secondary drain.

Figure 5:
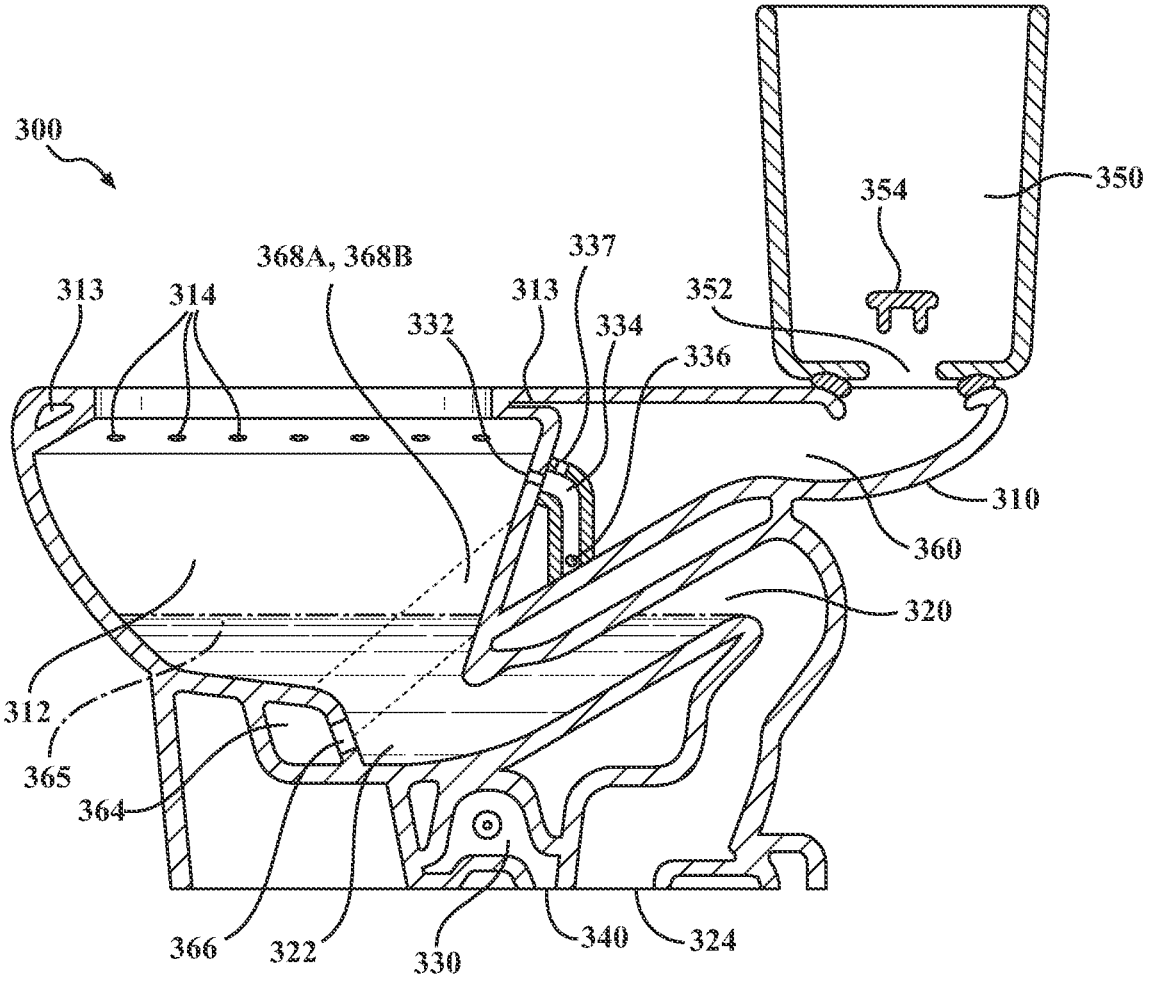
FIG. 5 schematically illustrates an alternative exemplary toilet configuration in side sectional view, including a secondary drain, wherein the secondary drain is connected to an annular connection feature in a toilet bowl and includes an auxiliary annular connection feature within a water supply plenum of the toilet configuration, further including a water supply plenum including two water pathways connecting in parallel to the water supply jet opening, and further including the secondary drain including an airlock relief annular connection feature at an upper point of the secondary drain, in accordance with the present disclosure.

FIG. 5 schematically illustrates an alternative exemplary toilet configuration in side sectional view, including a secondary drain, wherein the secondary drain is connected to an annular connection feature in a toilet bowl and includes an auxiliary annular connection feature within a water supply plenum of the toilet configuration, further including a water supply plenum including two water pathways connecting in parallel to the water supply jet opening, and further including the secondary drain including an airlock relief annular connection feature at an upper point of the secondary drain.

Configuration 300 includes fixture 310 with a water storage tank 350, a toilet bowl 312, and a primary drain 320. Water is held in the water storage tank 350 by tank valve 354. Once the tank valve 354 is opened, water rushes according to the pull of gravity through tank annular connection feature 352 and enters the water supply plenum 360 of the fixture 310. The water supply plenum 360 receives the flow of water from the water storage tank 350 and channels the water flow to different destinations for the purpose of flushing the fixture, emptying contents of the bowl, and refilling the bowl after the flush. A portion of the water flow within the water supply plenum 360 is channeled to a channel 313 circumventing the rim of the toilet bowl 312. Water within the channel 313 flows through annular connection features 314 and into the toilet bowl 312. A portion of the water flow within the water supply plenum 360 is channeled through a passage which progresses around the bowl and fluidly connects with the jet channel 364. Water exits the jet channel 364 through the water jet annular connection feature 366 to provide flushing action/head pressure to the primary drain 320 at a primary drain inlet 322. Water and waste from the toilet bowl 312 and water from jet channel 364 enter the primary drain 320 and flush through the primary drain 320 as the column of water and waste create a siphon in accordance with operation of a fixture as is used in the art. The water and waste exit the fixture through a primary drain outlet 324. The primary drain outlet 324 is coupled to a structure sewage pipe channeling the waste to other sewage pipes and subsequently out of the structure.

A secondary drain 334 is illustrated within the water supply plenum 360. The primary drain 320 and the toilet bowl 312 are configured such that during normal operation, water fills in the toilet bowl 312 until a corresponding operational fill water level 365 within the primary drain 320 causes water filling fixture to overflow the bend in primary drain 320. In this way, a normal water level for the bowl 312 to achieve during a filling cycle of the fixture is set at the operational fill water level 365. Because the operational fill water level 365 also defines a water level within water supply plenum 360, it is noted that any auxiliary annular connection feature 336 of the secondary drain 334 may be located above the bend in primary drain 320 and above the operational fill water level 365 such that water will not drain from the water supply plenum 360 through the secondary drain 334 when the bowl is filled to a normal designed level. However, the auxiliary annular connection feature 336 may be located within some threshold distance from water level 365 so as to begin draining the water supply plenum 360 as soon as water rises above the operational fill water level 365. In this way, the secondary drain has an enhanced ability to keep the water from overflowing the toilet bowl 312.

The secondary drain 334 is fluidly connected to the secondary drain channel 330. A channel may be formed integrally within the fixture 310 to connect the secondary drain 334 and the secondary drain channel 330. A channel connecting the secondary drain 334 and the secondary drain channel 330 may include a water trap according to plumbing methods used in the art. Water within secondary drain channel 330 may exit the fixture through the secondary drain outlet 340. In another embodiment, the secondary drain channel 330 may be configured to empty into the primary drain 320 just above the primary drain outlet 324. The primary drain outlet 324 and the secondary drain outlet 340 may be configured to connect to a standard plumbing connection used in the art. In such an embodiment, secondary drain outlet 340 may be configured to extend through a collar region of the fixture and discharge water directly into the standard plumbing connection. Water may be channeled from the water supply plenum 360 into secondary drain 334 through the auxiliary annular connection feature 336 for the purpose of flushing the secondary drain and cleaning it out.

If a clog in the primary drain 320 prevents water and waste from exiting the toilet bowl 312, the water level in the toilet bowl 312 rises. As the water level in the toilet bowl 312 rises, a water level within the water supply plenum 360 will also rise. As the water level within the water supply plenum 360 reaches and enters the auxiliary annular connection feature 336 of secondary drain 334, flows to the secondary drain channel 330, and flows out of the secondary drain outlet 340. By flowing through the secondary drain 334, water from the water supply plenum 360 bypasses the clog in the primary drain 320 and prevents the fixture from overflowing out of the bowl.

More than one secondary drain 334 and/or more than one auxiliary annular connection feature 336 may be used to channel water from the water supply plenum 360.

Secondary drain annular connection features such as the toilet bowl annular connection features 332 and the auxiliary annular connection feature 336 may be formed integrally with the wall during the process of constructing the fixture, for example, prior to the porcelain material being heated, or the secondary drain annular connection features being added to the walls of the fixture through a drilling process after the construction of the fixture.

The secondary drain 334 includes an airlock relief annular connection feature 337 at a top of the secondary drain 334. Additionally, dotted lines illustrate a first water pathway, the water pathway 368A, and a second water pathway, the water pathway 368B, each connecting the water supply plenum 360 to the water jet channel 364 and the water jet annular connection feature 366. Taken in combination, the toilet bowl annular connection features 332, the secondary drain 334, the auxiliary annular connection feature 336, the airlock relief annular connection feature 337, and the plurality of water pathways, including the water pathway 368A and the water pathway 368B, connecting the water supply plenum 360 and the water jet annular connection feature 366 collectively improve an ability and capacity of configuration 300 to enable water to bypass a clogged primary drain 320 and channel water through the secondary drain outlet 340.

The sewer pipe or the collar for the sewer pipe may be installed with the end of the sewer pipe or the collar thereof presenting a flat or substantially flat surface with the opening in a horizontal planar orientation for a toilet configuration to be installed thereto, with a wax ring typically being compressed between the fixture and sewer pipe. The primary drain of embodiments herein includes an outlet which may extend past a top surface or an opening of the sewer pipe such that liquids leaving the primary drain empty directly into the sewer pipe. Similarly, the secondary drain includes an outlet which may extend past a top surface or opening of the sewer pipe. The primary drain outlet and secondary drain outlet may be entirely separate tubes extending into the sewer line. In another example, for example, when the primary drain and secondary drain are unitarily formed, the primary drain outlet and the secondary drain outlet each may empty separately into the sewer pipe, however with a dividing wall separating the primary drain outlet and the secondary drain outlet not necessarily extending past the entrance to the sewer pipe.

Annular connection features described herein may be alternatively as short channels or annular connection features in a wall of a toilet configuration.

Research has shown that utilizing footrests that elevate the feet of a person using a toilet may include health benefits to the person. The large intestines may be pinched or crimped when a user sits in an upright position, with his or her thighs parallel to the ground. A separate plastic device is used in the art which nests with a front of the toilet and provides footrests for a user of the toilet to elevate his or her feet off of the ground and angle the user's thighs in relation to the ground surface. However, this separate plastic device may be problematic. For instance, the separate plastic device nested to a front surface of the toilet stands upon the ground, includes legs or other support structures to hold the footrest above the ground, and may prevent a standing user of the toilet from standing close to a bowl of the toilet, thereby causing sanitary issues for a standing user of the toilet. Further, the separate plastic device may be difficult to clean, may tend to only be cleaned upon a top surface of the plastic device, and may generally be a sanitary concern. Further, the separate plastic device may be moved away from the toilet, require effort to re-nest the separate plastic device to the toilet, and thereby may include a low compliance rate, with user's foregoing the use of the separate plastic device.

A toilet is disclosed including a footrest or footrests formed unitarily with the toilet, for example, including a one-piece construction made with a same ceramic material as a rest of the toilet. Such a unitary construction, being connected to and deriving structural support from the toilet does not need legs or support structure to the ground. As a result, an area under the toilet bowl may remain open such that a standing user of the toilet may stand in front of the toilet with one or more feet in the area under the toilet bowl. The toilet may have the beneficial footrest or footrests without forcing a standing user to stand back from the toilet. Further, as a one-piece construction, with the footrest or footrests being formed out of the same material as the rest of the toilet, one may simply clean all of the smooth surfaces of the toilet including the footrests for a beneficial sanitary effect. Further, because the footrest or footrests are formed unitarily with the toilet and are not separable from the toilet, the footrests are persistently present and may encourage or achieve higher compliance with footrest use as compared to a separate plastic footrest device.

Figure 6:
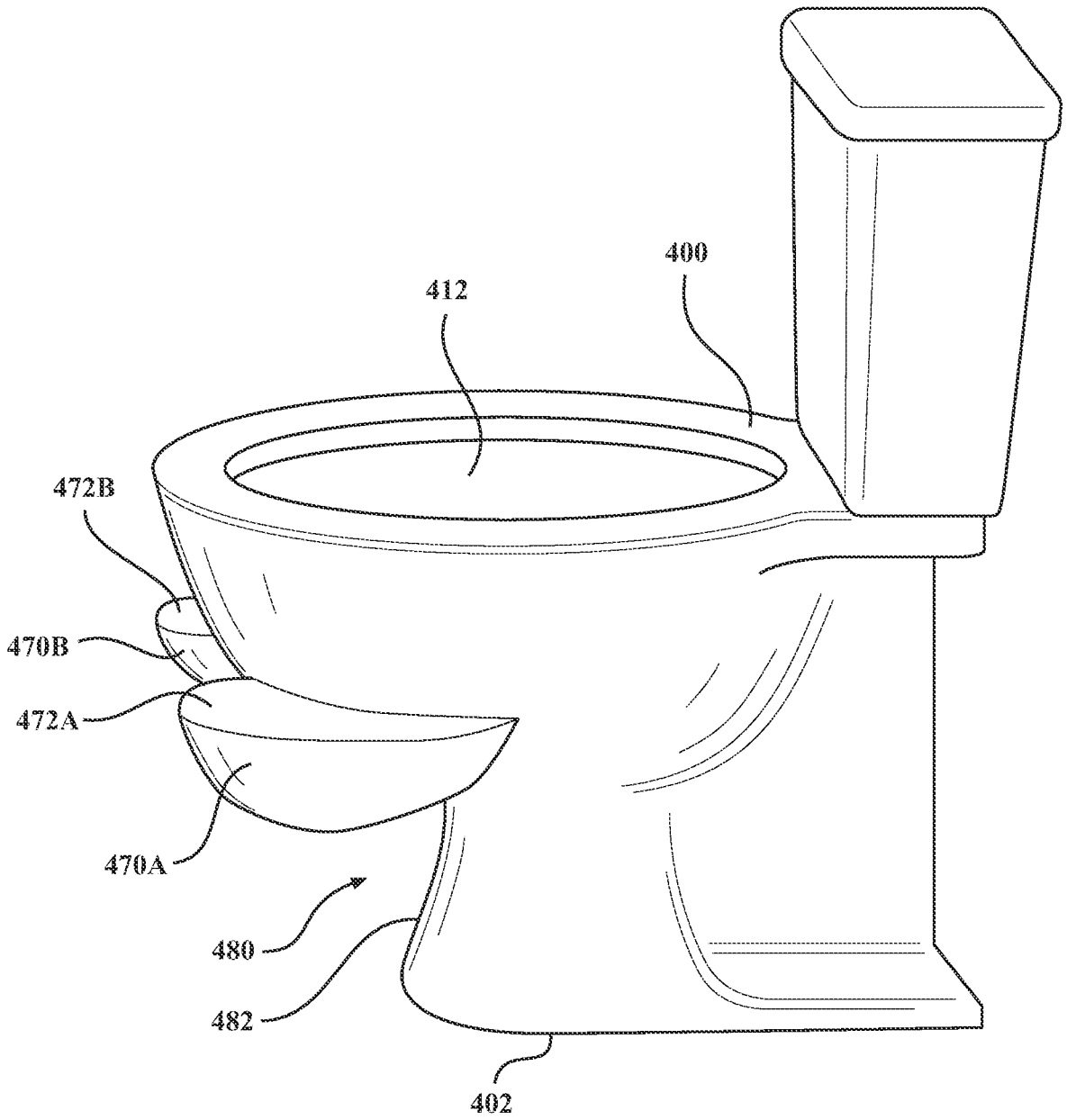
FIG. 6 schematically illustrates an alternative exemplary toilet configuration in side perspective view, including a pair of footrests disposed upon an outside of a toilet bowl, in accordance with the present disclosure.

FIG. 6 schematically illustrates a toilet including a first footrest and a second footrest formed unitarily with the toilet. Toilet 400 is illustrated including toilet bowl 412. A first footrest 470A and a second footrest 470B are illustrated formed upon opposite sides of an exterior of the toilet bowl 412. The first footrest 470A includes a footrest surface 472A. The second footrest 470B includes a footrest surface 472B. The footrest surface 472A and the footrest surface 472B may be flat or may be curved. The footrest surface 472A and the footrest surface 472B may be disposed at different heights as compared to a ground surface consistent with a bottom 402 of the toilet 400 or may be a same height as compared to the ground surface. The first footrest 470A, the footrest surface 472A, the second footrest 470B, and the footrest surface 472B are illustrated with exemplary geometries and resulting heights above a ground surface consistent with the bottom 402 of the toilet 400. The toilet 400 includes a wall 482 recessed under the toilet bowl 412 such that a standing user of the toilet may place feet within area 480 under the toilet bowl 412. Other similar toilets with different geometries and heights of the footrests and footrest surfaces are envisioned, and the disclosure is not intended to be limited to the embodiments provided herein.

Figure 7:
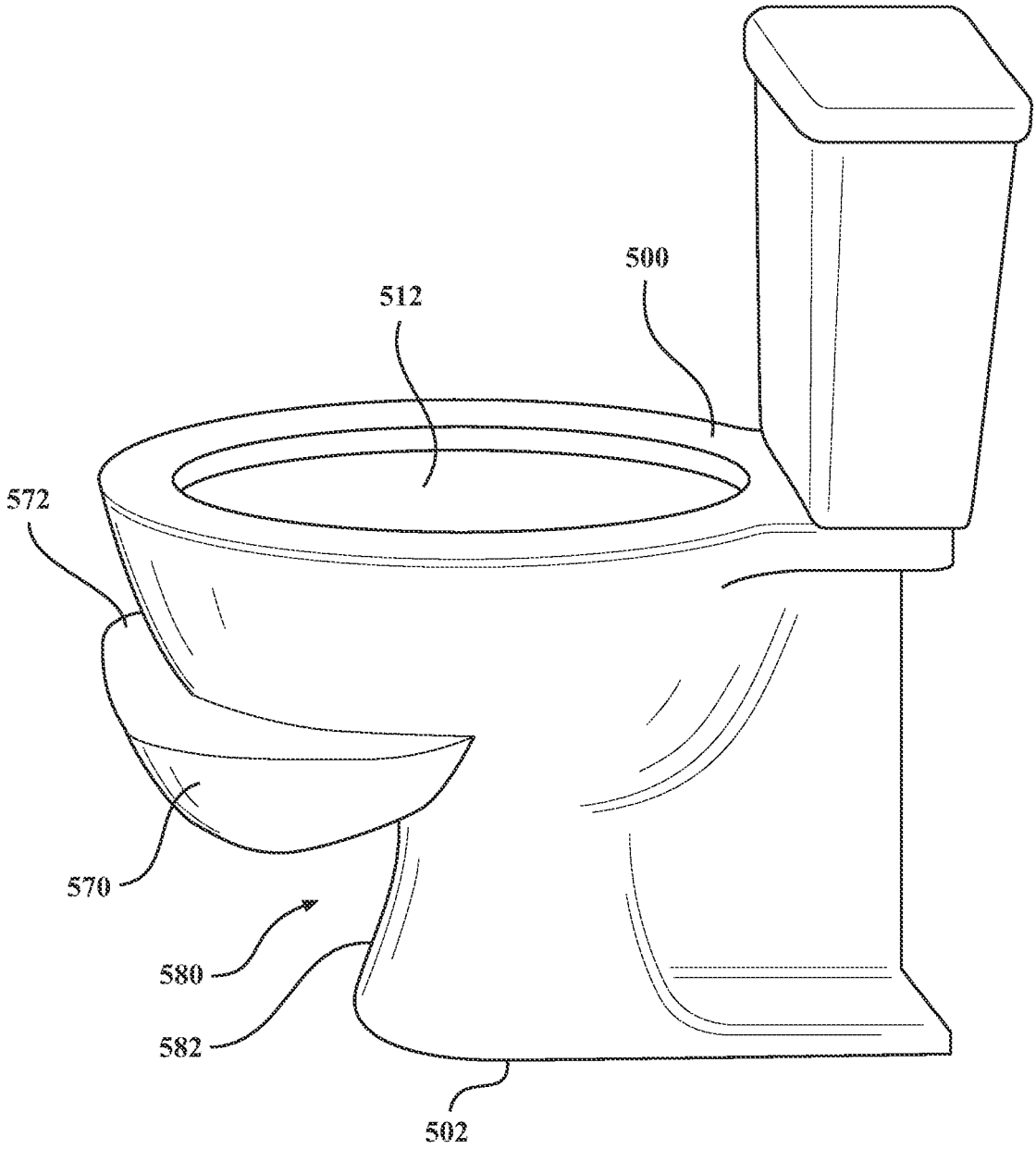
FIG. 7 schematically illustrates an alternative exemplary toilet configuration in side perspective view, including a single footrest spanning from a first side of the toilet configuration to a second side of the toilet configuration, in accordance with the present disclosure.

FIG. 7 schematically illustrates a toilet including a single footrest formed unitarily with the toilet extending from one side of the toilet to a second side of the toilet. Toilet 500 is illustrated including toilet bowl 512. A footrest 570 is illustrated spanning between opposite sides of an exterior of the toilet bowl 512. The footrest 570 includes a footrest surface 572. The footrest surface 572 may be flat or may be curved. The footrest 570 and the footrest surface 572 are illustrated with exemplary geometries and a resulting height above a ground surface consistent with the bottom 502 of the toilet 500. The toilet 500 includes a wall 582 recessed under the toilet bowl 512 such that a standing user of the toilet may place feet within area 580 under the toilet bowl 512. Other similar toilets with different geometries and heights of the footrests and footrest surfaces are envisioned, and the disclosure is not intended to be limited to the embodiments provided herein.

The disclosed toilets are specially designed or adapted for the use or benefit of the blind or other physically or mentally handicapped persons.

A toilet with a secondary drain and with one or more footrests formed unitarily with the toilet may cooperatively benefit users, in particular, users including a physical or mental disability. The disclosed toilets are specially designed or adapted for the use or benefit of blind users, deaf users, users with dementia, or other physically or mentally handicapped persons. A user with a physical disability may have difficulty using a toilet due to physical limitations that prevent the user from sensing body sensations or prevent the user from adjusting body position to facilitate toilet use. Further, a user with a physical or mental disability may lack cognition and/or a response time to notice and take action to stop a toilet from overflowing. By enabling easy placement of the feet of the user upon the footrest or footrests, the user may experience ease of use of the toilet, helping the user and additionally helping any caregiver assisting the user. Further, the secondary drain of the toilet prevents waste and water from overflowing the toilet due to a clogged primary drain, thereby preventing an unsanitary condition for the user and the caregiver. It is noted that these features, presence of a secondary drain and of at least one unitarily formed footrest, include non-mechanical (no moving parts) and non-electrical functionality, so that neither require maintenance or upkeep for a handicap or non-handicap family member to worry about once toilet is installed. Any similar device in the art with moving parts and/or electrical actuation require upkeep and are subject to breaking down over time.

Figure 8:
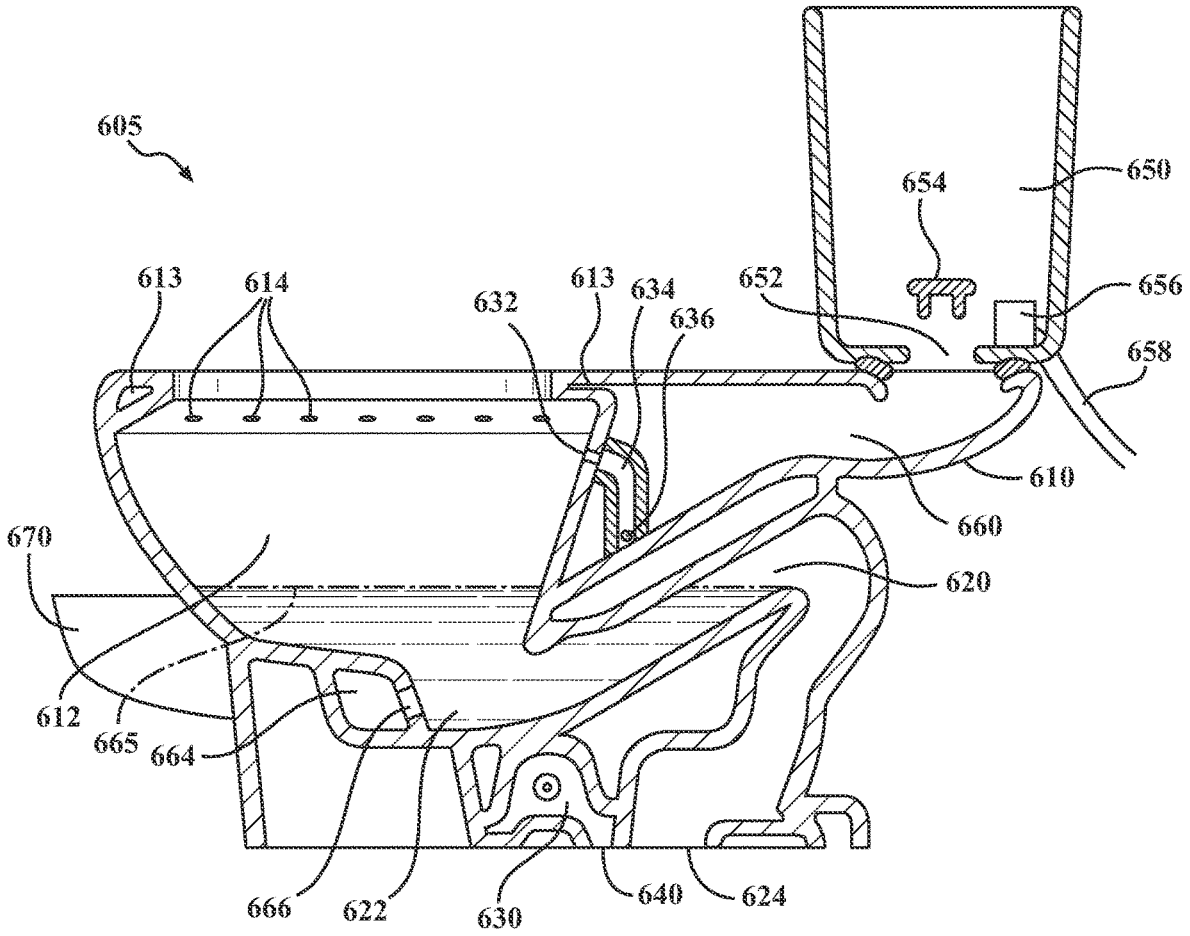
FIG. 8 schematically illustrates an alternative exemplary toilet configuration in side sectional view, similar to the toilet configuration of FIG. 1, including a pair of footrests disposed upon an outside of a toilet bowl, in accordance with the present disclosure.

FIG. 8 schematically illustrates an exemplary toilet configuration in side sectional view including a secondary drain and a footrest, wherein the secondary drain is connected to an annular connection feature in a toilet bowl and includes an auxiliary annular connection feature within a water supply plenum of the toilet configuration. Configuration 605 includes fixture 610 with a water storage tank 650, a toilet bowl 612, a primary drain 620, and a footrest 670. Configuration 605 is similar to the configuration 5 of FIG. 1 with the addition of the footrest 670. Water is held in the water storage tank 650 by tank valve 654. Once the tank valve 654 is opened, water rushes according to the pull of gravity through tank annular connection feature 652 and enters the water supply plenum 660 of the fixture 610. Water supply plenum 660 is a closed fluid connection and fluidly connects water storage tank 650 with toilet bowl 612. In another embodiment, a flushometer-type valve may be used with a tank-less toilet, wherein depression of the flushometer-type valve causes a surge of water to enter the water supply plenum 660. A wide variety of toilet designs are envisioned for use with the configurations disclosed herein, and the disclosure is not intended to be limited by the particular examples provided. The water storage tank 650 may include a water supply fill valve 656 connected to a water supply line 658 to provide a selective flow of water into the water storage tank 650. The water supply plenum 660 receives the flow of water from the water storage tank 650 and channels the water flow to different destinations for the purpose of flushing the fixture, emptying contents of the bowl, and refilling the bowl after the flush. A portion of the water flow within the water supply plenum 660 is channeled to a channel 613 circumventing the rim of the toilet bowl 612. Water within the channel 613 flows through annular connection features 614 and into the toilet bowl 612. A portion of the water flow within the water supply plenum 660 is channeled through a passage which progresses around the bowl and fluidly connects with the jet channel 664. Water exits the jet channel 664 through the water jet annular connection feature 666 to provide flushing action/head pressure to the primary drain 620 at a primary drain inlet 622. Water and waste from the toilet bowl 612 and water from jet channel 664 enter the primary drain 620 and flush through the primary drain 620 as the column of water and waste create a siphon in accordance with operation of a fixture as is used in the art. The water and waste exit the fixture through a primary drain outlet 624. The primary drain outlet 624 is coupled to a structure sewage pipe channeling the waste to other sewage pipes and subsequently out of the structure.

The footrest 670 is illustrated as being attached to one side of the toilet bowl 612. A second footrest is disposed at an opposite position on the other side of the toilet bowl 612, as is illustrated in the exemplary footrests of FIG. 6. In another embodiment, a single footrest may span an entire front of the configuration 605.

A secondary drain 634 is illustrated within the water supply plenum 660. The secondary drain 634 includes toilet bowl annular connection features 632 operable to drain water from the toilet bowl 612 if water rises within toilet bowl 612 to the level of the toilet bowl annular connection features 632. The primary drain 620 and the toilet bowl 612 are configured such that during normal operation, water fills in the toilet bowl 612 until a corresponding operational fill water level 665 within the primary drain 620 causes water filling fixture to overflow the bend in primary drain 620. In this way, a normal water level for the bowl 612 to achieve during a filling cycle of the fixture is set at the operational fill water level 665. When the primary drain 620 clogs, water entering the toilet bowl 612 through the water supply plenum 660 rises, and if this rise in the water level is unchecked, the water may overflow the toilet bowl 612. The toilet bowl annular connection features 632 prevent such an overflow by permitting water to bypass the primary drain 620 through the secondary drain 634. Additionally, an auxiliary annular connection feature 636 may be formed in the secondary drain 634 within the water supply plenum 660, such that water filling the water supply plenum 660 over the operational fill water level 665 may additionally bypass the primary drain 620.

Because the operational fill water level 665 also defines a water level within water supply plenum 660, it is noted that any auxiliary annular connection feature 636 of the secondary drain 634 may be located above the bend in primary drain 620 and above the operational fill water level 665 such that water will not drain from the water supply plenum 660 through the secondary drain when the bowl is filled to a normal designed level. However, the auxiliary annular connection feature 636 may be located within some threshold distance from water level 665 so as to begin draining the water supply plenum 660 as soon as water rises above the operational fill water level 665. In this way, the secondary drain has an enhanced ability to keep the water from overflowing the toilet bowl 612.

The secondary drain 634 is fluidly connected to the secondary drain channel 630. A passage may be formed integrally within the fixture 610 to connect the secondary drain 634 and the secondary drain channel 630. A passage connecting the secondary drain 634 and the secondary drain channel 630 may include a water trap according to plumbing methods used in the art. Water within secondary drain channel 630 may exit the fixture through the secondary drain outlet 640. In another embodiment, the secondary drain channel 630 may be configured to empty into the primary drain 620 just above the primary drain outlet 624. The primary drain outlet 624 and the secondary drain outlet 640 may be configured to connect to a standard plumbing connection used in the art. In such an embodiment, secondary drain outlet 640 may be configured to extend through a collar region of the fixture and discharge water directly into the standard plumbing connection. Water may be channeled from the water supply plenum 660 into secondary drain 634 through the auxiliary annular connection feature 636 for the purpose of flushing the secondary drain and cleaning it out.

If a clog in the primary drain 620 prevents water and waste from exiting the toilet bowl 612, the water level in the toilet bowl 612 rises and eventually flows through the toilet bowl annular connection features 632. As the water level in the toilet bowl 612 rises, a water level within the water supply plenum 660 will also rise. Water from the toilet bowl annular connection features 632 and from the auxiliary annular connection feature 636 flows to the secondary drain channel 630, and flows out of the secondary drain outlet 640. By flowing through the secondary drain, water bypasses the clog in the primary drain 620 and prevents the fixture from overflowing out of the bowl. By sizing the toilet bowl annular connection features 632, the auxiliary annular connection feature 636, and the secondary drain 634 adequately, a broken water supply fill valve 656 may be accounted for, with an unrestricted flow of water from the water supply line 658 being channeled through the secondary drain without the toilet overflowing.

More than one secondary drain 634 and/or more than one auxiliary annular connection feature 636 may be used to channel water from the water supply plenum 660.

Secondary drain annular connection features such as the toilet bowl annular connection features 632 and the auxiliary annular connection feature 636 may be formed integrally with the wall during the process of constructing the fixture, for example, prior to the porcelain material being heated, or the secondary drain annular connection features may be added to the walls of the fixture through a drilling process after the construction of the fixture.

The embodiment of FIG. 8 includes the jet channel 664. Some toilet configurations include a water jet channel and some do not. A secondary drain inlet within a water supply plenum may still work within a fixture wherein water enters the bowl through annular connection features around the rim. However, water from the rising level in the bowl will not enter the plenum until the water level exceeds the height of the annular connection features around the rim. In such an exemplary configuration, larger annular connection features around the rim and/or a portion of annular connection features around the rim placed lower in the bowl could facilitate water flowing from a bowl back into the plenum before the water level gets too high in the bowl.

Figure 9:
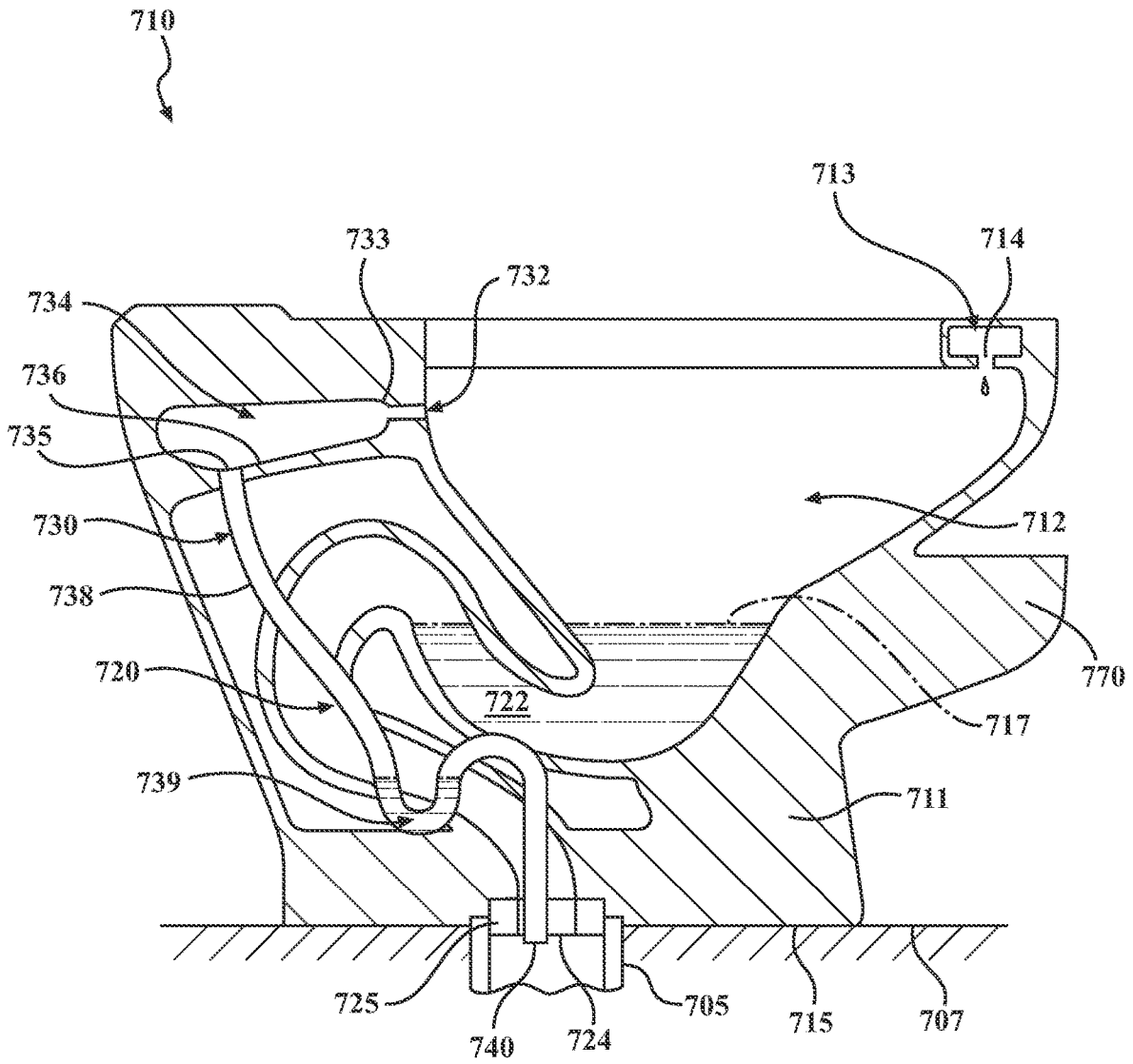
FIG. 9 schematically illustrates an alternative exemplary toilet configuration in side sectional view, including a footrest spanning from a first side of an outside of a toilet bowl to a second side of the outside of the toilet bowl and a secondary drain fluidly connected to at least one hole in an inside of the toilet bowl, in accordance with the present disclosure.

FIG. 9 schematically illustrates in side sectional view a second embodiment of a toilet including a footrest and a secondary drain. Configuration 710 is illustrated including a primary drain 720 and a secondary anti-overflow drain 730. A footrest 770 is illustrated as being attached to and spanning across a front side of the toilet bowl.

The configuration 710 includes a structural body 711 containing a generally annular-shaped bowl or basin 712 that receives the waste material and a primary drain 720 that is in fluid communication with the basin 712. The primary drain 720 is configured having a series of bends that form a liquid trap 722. This liquid trap 722 operates to cause an amount of water to remain within the basin 712 after each time the configuration 710 is used or flushed. It may be appreciated that the waterline 717, i.e., the height of the amount of water left in the basin 712 after each flush, is determined by the relative volumes of the basin 712 and the primary drain 720 and the height that trap 722 extends upward relative to the basin 712.

A tank or source of flushing water of conventional design is fluidly coupled to the configuration 710 to provide the water useful to flush the contents of the configuration 710. The tank may be located in substantially any position relative to the configuration 710. For example, the tank may be physically mounted directly to the configuration 710 or at a remote position. Similarly, a pressurized water line and a check valve system may be employed in place of the tank system as a source of flushing water.

Further, the configuration 710 also includes a rim 713 which defines the upper edge of basin 712. The rim 713 includes a plurality of flush water outlets 714. These flush water outlets 714 are fluidly coupled to a source of flushing water, such as the above-described tank. The flush water outlets 714 are oriented to direct an amount of flushing water to cascade down the basin 712 each time the configuration 710 is flushed.

It may be appreciated that in the configuration 710, which has its body 711 configured as a toilet, a seat may be mounted upon the rim 713.

With respect to configuration 710, the primary drain 720 terminates at a primary discharge port 724 located in close proximity to the bottom edge 715 of the configuration 710. The primary discharge port 724 includes a cylindrical collar 725 that is sized to slide into the opening of a standard sanitary line or plumbing 705 that is normally found beneath a bathroom floor 707. It may be appreciated that the plumbing 705 is a length of conventional pipe that is usually orthogonal to the floor and terminates either even with or projects slightly above the level of the floor 707. In combination with a conventional sealing material, such as a wax ring, the primary discharge port 724 and the plumbing 705 are fluidly coupled to enable the drain 720 to act as the primary means for flushing waste material down the configuration 710.

Configuration 710 includes a secondary drain 730 that is fluidly coupled to the basin 712 through a plurality of inlet holes 732 formed in a wall of the basin 712. These holes 732 are formed in the basin 712 at a location that is above the typical waterline 717 of the configuration 710. Each of the inlets 732 are located below the flush water outlets 714 found in the rim 713.

In one embodiment of the disclosure, there are three to five inlet holes 732 that are each approximately ⅜ inch in diameter. In one embodiment, the holes 732 are disposed in a line that is substantially parallel to the waterline 717 and located approximately one to three inches beneath the rim 713. This location of the holes 732 ensures that wastewater will not enter holes 732 unless there is a blockage (i.e., when waste water backs up toward the top of the basin 712), while concomitantly receiving a small amount of the water being emitted from the flush water outlets 714 during each flush to keep the drain 730 relatively clean and preventing the water in the drain 730 from becoming stagnant.

The location, quantity, size, shape and orientation relative to each other of the inlet holes 732 may vary and inlet holes 732 need only be disposed below the outlets 714 and above the waterline 717 to operate as inlets for secondary drain 730.

The secondary drain 730 may include an overflow reservoir 734. Reservoir 734 is an enclosed generally rectangular member that is disposed in the body 711 of the configuration 710. The reservoir 734 has a front side 733 that is in fluid communication with each of the inlet holes 732. The bottom or floor 736 of reservoir 734 angles downward away from front side 733 and inlets 732 and terminates at an outlet hole 735 located at the lowest point of reservoir 734. As shown, reservoir 734 is shaped to receive any liquid from inlets 732 and funnel that liquid toward the outlet hole 735 formed in the bottom of the reservoir.

The secondary drain 730 further includes an overflow drain tube 738. In the preferred embodiment of the disclosure, the overflow drain tube 738 is approximately one-half inch in inside diameter and is fluidly coupled to the outlet hole 735.

The overflow drain tube 738 extends down the body 711 to a secondary discharge port 740. The secondary discharge port 740 passes through an annular connection feature formed in the collar 725 and extends approximately one-half to one inch beyond the collar 725. When coupled to the plumbing 705, the extended length of port 740 beyond the collar 725 causes the secondary drain 730 to physically project into the plumbing 705 beyond the primary discharge port 724 of the primary drain 720.

The overflow drain tube 738 is configured having a series of bends that form a liquid trap 739. This liquid trap 739 is disposed along the length of the overflow drain tube 738 between the outlet hole 735 and the secondary discharge port 740. The liquid trap 739 operates to cause an amount of water to remain within the overflow drain tube 738 after each time the configuration 710 is used or flushed. This trapped water in the overflow drain tube 738 prevents sewer gases and odors from passing through the secondary drain 730 into the lavatory.

Figure 10:
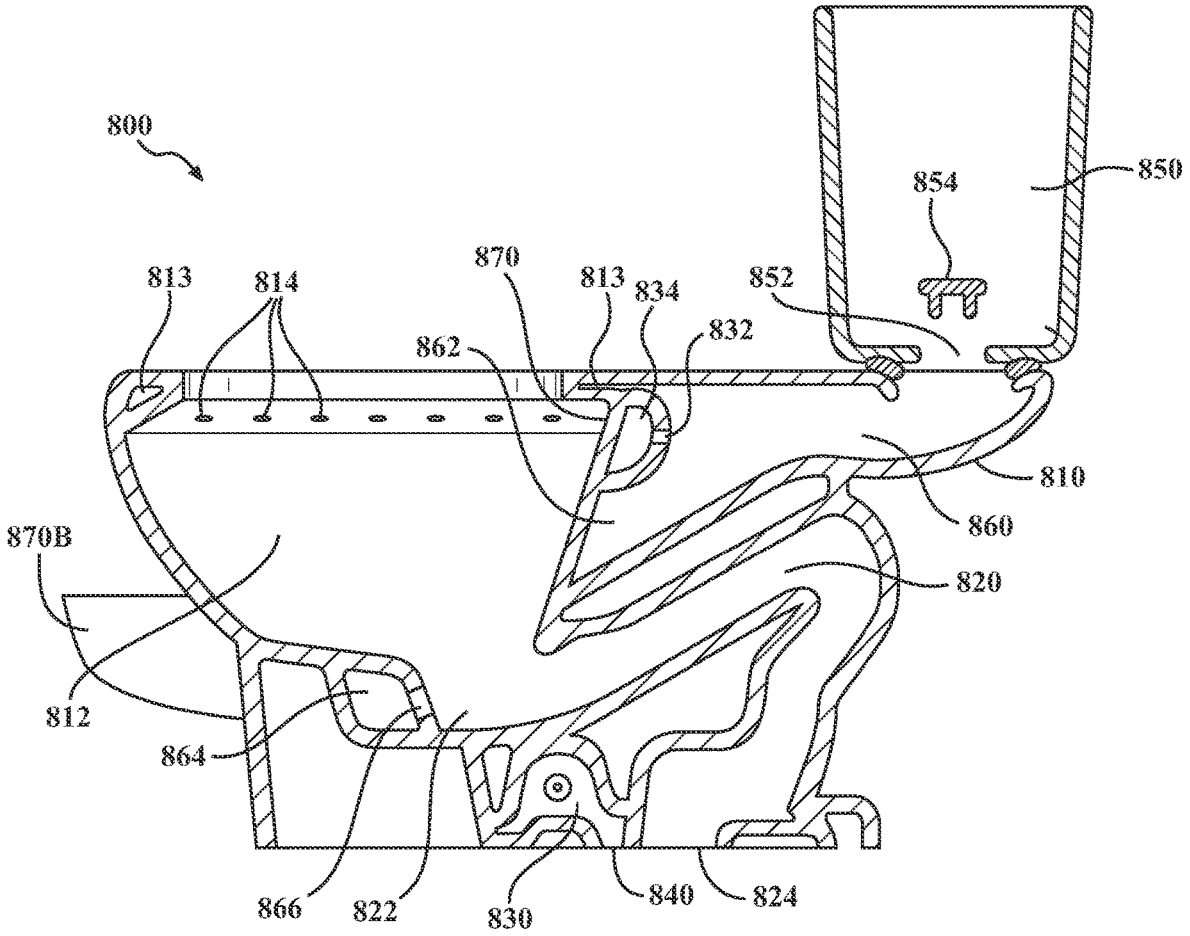
FIG. 10 schematically illustrates an alternative exemplary toilet configuration in side sectional view, including a pair of footrests disposed upon an outside of a toilet bowl and with a secondary drain fluidly connected to at least one hole within a water supply plenum, in accordance with the present disclosure.

FIG. 10 illustrates in cross-section an additional embodiment of the disclosure wherein a hole internal to a water supply plenum provides a secondary drain to a fixture. Configuration 800 includes fixture 810 with a water tank 850, a bowl 812, and a primary drain 820. A footrest 870B is illustrated as being attached to one side of the toilet bowl. A second footrest is disposed at an opposite position on the other side of the toilet bowl, as is illustrated in the exemplary footrests of FIG. 6. Water is held in water tank 850 by tank valve 854. Once tank valve 854 is opened, water rushes according to the pull of gravity through tank hole 852 and enters water supply plenum 860 of fixture 810. In another embodiment, a flushometer-type valve may be used with a tank-less toilet, wherein depression of the valve causes a surge of water to enter water supply plenum 860. A wide variety of toilet designs are envisioned for use with the configurations disclosed herein, and the disclosure is not intended to be limited by the particular examples provided. Water supply plenum 860 receives the flow of water from tank 850 and channels the water flow to different destinations for the purpose of flushing the fixture, emptying contents of the bowl, and refilling the bowl after the flush. A portion of the water flow within water supply plenum 860 is channeled to a channel 813 circumventing the rim of bowl 812. Water within channel 813 flows through holes 814 and into bowl 812. A portion of the water flow within water supply plenum 860 is channeled through passage 862 which progresses around the bowl and fluidly connects with jet channel 864. Water exits jet channel 864 through hole 866 to provide flushing action/head pressure to primary drain 820 at primary drain inlet 822. Water and waste from bowl 812 and water from jet channel 864 enter primary drain 820 and flush through the primary drain 820 as the column of water and waste create a siphon in accordance with operation of a fixture as is used in the art. The water and waste exit the fixture through primary drain outlet 824. Primary drain outlet 824 is coupled to a structure sewage pipe channeling the waste to other sewage pipes and subsequently out of the structure.

A secondary drain inlet 834 is illustrated within water supply plenum 860. A secondary drain hole 832 permits water to flow from the water supply plenum 860 into secondary drain inlet 834. One secondary drain hole 832 may be provided or a plurality of secondary drain holes 832 may be provided. One having skill in the art will appreciate that the primary drain 820 and bowl 812 are configured such that during normal operation, water fills in the bowl 812 until a corresponding water level within primary drain 820 causes water filling fixture to overflow the bend in primary drain 820. In this way, a normal water level for the bowl 812 to achieve during a filling cycle of the fixture is set. Because a corresponding water level also fills within water supply plenum 860, it is noted that any secondary drain holes 832 may be located above the bend in primary drain 820 such that water will not drain from the water supply plenum 860 through the secondary drain inlet 834 when the bowl is filled to a normal designed level.

Secondary drain inlet 834 is fluidly connected to secondary drain channel 830. A channel may travel integrally within fixture 810 to connect the secondary drain inlet 834 and the secondary drain channel 830. A channel connecting the secondary drain inlet 834 and the secondary drain channel 830 may include a water trap according to plumbing methods used in the art. Water within secondary drain channel 830 may exit the fixture through secondary drain outlet 840. In another embodiment, secondary drain channel 830 may be configured to empty into the primary drain 820 just above primary drain outlet 824. Primary drain outlet 824 and secondary drain outlet 840 may be configured to connect to a standard plumbing connection used in the art. Water may be channeled from water supply plenum 860 into secondary drain inlet 834 for the purpose of flushing the secondary drain and cleaning it out.

If a clog in primary drain 820 prevents water and waste from exiting bowl 812, the water level in bowl 812 rises. One having skill in the art will appreciate that as the water level in bowl 812 rises, a water level within the water supply plenum 860 will also rise. As the water level within the plenum reaches secondary drain hole 832, water enters secondary drain inlet 834, flows to secondary drain channel 830, and flows out of secondary drain outlet 840. By flowing through the secondary drain, water from the water supply plenum 860 bypasses the clog in the primary drain 820 and prevents the fixture from overflowing out of the bowl.

In addition to secondary drain hole 832, a secondary drain hole or holes may be added to a wall separating the bowl 812 and the secondary drain inlet 834 at point 870. Holes in both the bowl 812 and the water supply plenum 860 leading to the secondary drain may facilitate increased flow bypassing a clog in the primary drain 820, thereby decreasing a chance that the water level in the bowl will rise to a level where overflow out of the bowl occurs.

Secondary drain hole 832 is illustrated on a vertical wall of secondary drain inlet 834. Different locations of drain hole 832 will change how much water is channeled from the water supply plenum 860 into the secondary drain inlet 834. In one exemplary embodiment, a hole facing a direction that the water is flowing from within the water supply plenum 860 will be more likely to get a large amount of water flowing through the hole. A hole facing away from the direction that the water is flowing from or a hole shielded in some way from the flow of water within the plenum may get a reduced amount of water flowing through the hole. A combination of hole locations may be used, for example, with a single hole located to receive a large amount of water to facilitate flushing out the secondary drain and with two other holes shielded from the flow within plenum to reduce how much water is channeled from the plenum through the holes but still receiving water when the water level in the bowl and plenum begins to rise due to a clog. Locations, orientations, sizes, and numbers of secondary drain holes may be determined experimentally, through computerized modeling, or by any method sufficient to contemplate flow of water through an exemplary fixture.

Secondary drain holes may be formed integrally with the wall during the process of constructing the fixture, for example, prior to the porcelain material being heated, or the secondary drain holes may be added to the walls of the fixture through a drilling process after the construction of the fixture.

The embodiment of FIG. 10 includes jet channel 864. Some toilet configurations include a water jet channel and some do not. A secondary drain inlet within a water supply plenum may still work within a fixture wherein water only enters the bowl through holes around the rim. However, water from the rising level in the bowl will not enter the plenum until the water level exceeds the height of the holes around the rim. In such an exemplary configuration, larger holes around the rim and/or a portion of holes around the rim placed lower in the bowl could facilitate water flowing from a bowl back into the plenum before the water level gets too high in the bowl.

Figure 11:
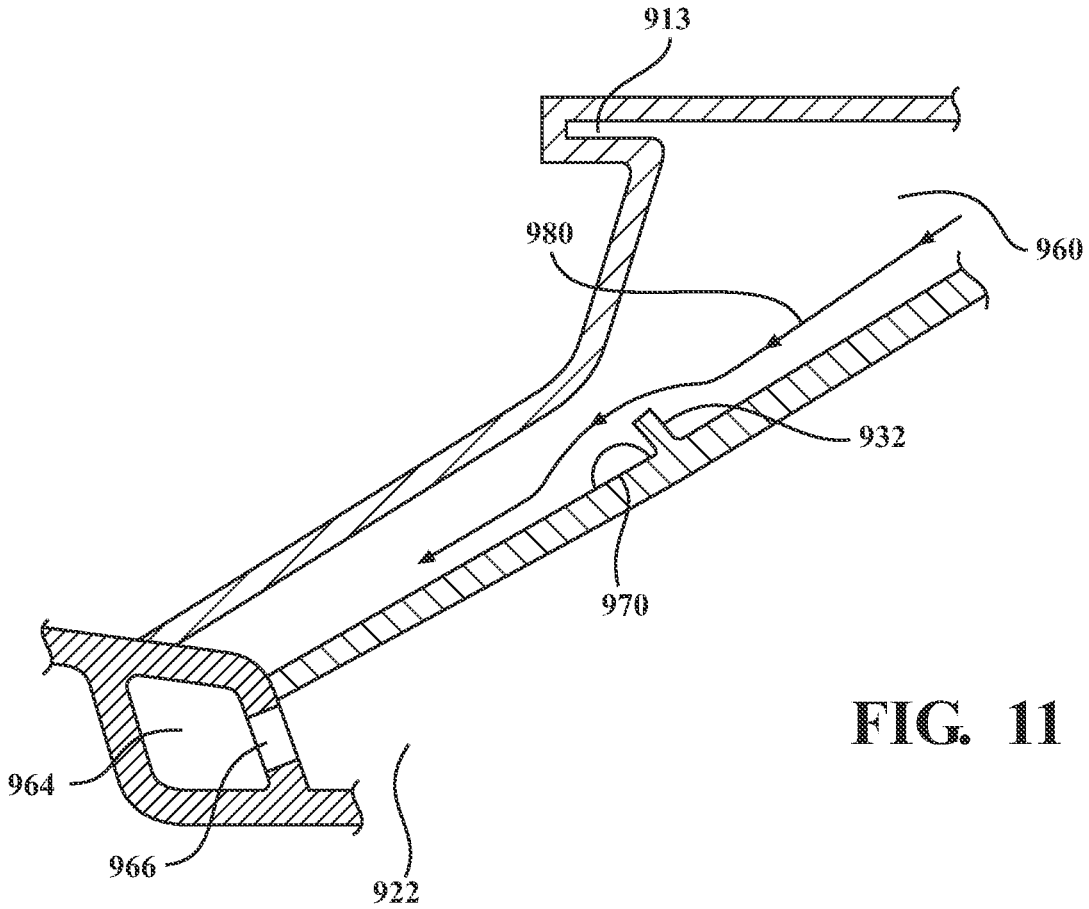
FIG. 11 schematically illustrates an exemplary water supply plenum of a toilet configuration in side sectional view, including a secondary drain inlet and a diverter wall shielding the secondary drain inlet, with a flow of water flowing past the secondary drain inlet on route to a toilet bowl, in accordance with the present disclosure.

FIG. 11 illustrates in detail water flowing through a water supply plenum as illustrated in FIG. 10, the water being supplied from a tank to a water jet flushing the fixture, the water being channeled past a secondary drain inlet hole such that only a minor portion of the water flow enters the secondary drain inlet hole. An alternative water supply plenum 960 is illustrated including a channel 913 leading to holes around a perimeter of a top of a toilet bowl, jet channel 964, and water jet hole 966 supplying a water flow 980 to primary drain inlet 922. Diverter structure 932 is illustrated diverting water away from secondary drain inlet 970, permitting some water to enter inlet 970 but reducing the amount of water as compared to how much would flow into inlet 970 if diverter structure 932 were not in place.

Figure 12:
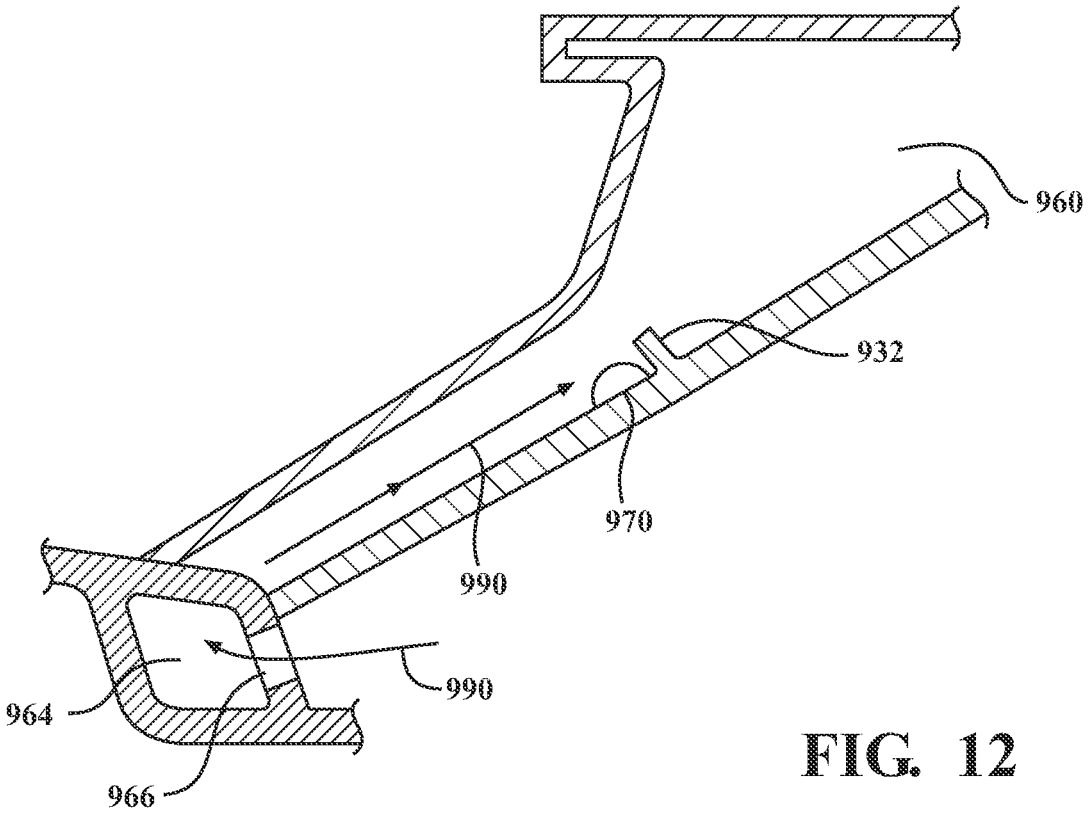
FIG. 12 schematically illustrates the water supply plenum of FIG. 11 in side sectional view, include a backed-up flow of water flowing from the toilet bowl into the secondary drain inlet, in accordance with the present disclosure.

FIG. 12 illustrates in detail the water supply plenum of FIG. 11, with a back-up flow of water entering the plenum and entering the secondary drain inlet hole. Water supply plenum 960 is illustrated including jet channel 964, and water jet hole 966 supplying a water flow 990 backing up from primary drain inlet 922 into jet channel 964. While diverter structure 932 is illustrated above secondary drain inlet 970, flow 990 is unaffected by diverter structure 932 and may drain freely into secondary drain inlet 970.

The disclosure has described certain embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A toilet configuration that is connectable to a sewer drainage pipe, the toilet configuration comprising:

a water storage tank;

a ceramic toilet body including a toilet bowl including a waste receiving basin;

a water supply plenum operable to receive water from the water storage tank and channel the water to the toilet bowl;

a primary drain operable to fluidly connect the waste receiving basin and the sewer drainage pipe;

at least one footrest formed unitarily with an outer surface of the ceramic toilet body, wherein the at least one footrest is operable to aid a user in elevating at least one knee while the user is seated upon the toilet configuration;

a secondary drain operable to drain the water from the toilet bowl into the sewer drainage pipe, wherein the secondary drain is separate from the primary drain;

a water supply jet outlet operable to receive the water channeled by the water supply plenum and direct the water into the waste receiving basin;

wherein the waste receiving basin includes an upper rim and at least one toilet bowl annular connection feature in a side wall of the waste receiving basin;

wherein the secondary drain is operable to fluidly connect the toilet bowl annular connection feature to the sewer drainage pipe and operable to drain the water from the toilet bowl annular connection feature into the sewer drainage pipe;

wherein the secondary drain includes an auxiliary annular connection feature fluidly connecting the secondary drain to the water supply plenum, wherein the auxiliary annular connection feature is operable to drain the water from the water supply plenum into the sewer drainage pipe;

wherein the water supply plenum includes two water pathways connecting the water supply plenum to the water supply jet outlet, the two water pathways including a first water pathway extending around a first side of the toilet bowl and a second water pathway extending around a second side of the toilet bowl;

wherein the auxiliary annular connection feature is located vertically below the at least one toilet bowl annular connection feature; and wherein the toilet configuration is specially designed to be utilized to provide a toileting option to handicapped and disabled persons.

2. A toilet configuration that is connectable to a sewer drainage pipe, the toilet configuration comprising:

a water storage tank;

a ceramic toilet body including a toilet bowl including a waste receiving basin that includes an upper rim and at least one toilet bowl annular connection feature in a side wall of the waste receiving basin;

a water supply plenum operable to receive water from the water storage tank and channel the water to the toilet bowl;

a primary drain operable to fluidly connect the waste receiving basin and the sewer drainage pipe; and a secondary drain operable to fluidly connect the toilet bowl annular connection feature to the sewer drainage pipe and operable to drain the water from the toilet bowl into the sewer drainage pipe, wherein the secondary drain is separate from the primary drain and includes an auxiliary annular connection feature located vertically below the at least one toilet bowl annular connection feature fluidly connecting the secondary drain to the water supply plenum, wherein the auxiliary annular connection feature is operable to drain the water from the water supply plenum into the sewer drainage pipe;

at least one footrest formed unitarily with an outer surface of the ceramic toilet body, wherein the at least one footrest is operable to aid a user in elevating at least one knee while the user is seated upon the toilet configuration; and wherein the toilet bowl annular connection feature and the auxiliary annular connection feature are operable to permit the water to bypass the primary drain when the primary drain is clogged.

3. The toilet configuration of claim 2, wherein the at least one footrest includes a single footrest spanning from a first side of the outer surface to a second side of the outer surface.

4. The toilet configuration of claim 2, wherein the at least one footrest includes a first footrest disposed upon a first side of the outer surface and a second footrest disposed upon a second side of the outer surface.

5. A toilet configuration that is connectable to a sewer drainage pipe, the toilet configuration comprising:

a water storage tank;

a ceramic toilet body including a toilet bowl including a waste receiving basin that includes an upper rim and at least one toilet bowl annular connection feature in a side wall of the waste receiving basin;

a water supply plenum operable to receive water from the water storage tank and channel the water to the toilet bowl;

a primary drain operable to fluidly connect the waste receiving basin and the sewer drainage pipe;

at least one footrest formed unitarily with an outer surface of the ceramic toilet body, wherein the at least one footrest is operable to aid a disabled user in elevating at least one knee while the disabled user is seated upon the toilet configuration;

a secondary drain operable to fluidly connect the toilet bowl annular connection feature to the sewer drainage pipe and operable to drain the water from the toilet bowl into the sewer drainage pipe, wherein the secondary drain is separate from the primary drain and includes an auxiliary annular connection feature located vertically below the at least one toilet bowl annular connection feature fluidly connecting the secondary drain to the water supply plenum, wherein the auxiliary annular connection feature is operable to drain the water from the water supply plenum into the sewer drainage pipe and prevent the disabled user from causing the toilet configuration to overflow; and wherein the toilet bowl annular connection feature is operable to permit the water to bypass the primary drain when the primary drain is clogged.

* * * * *